US012305475B2

(12) United States Patent
Eldho et al.

(10) Patent No.: US 12,305,475 B2
(45) Date of Patent: May 20, 2025

(54) ACTIVATION MECHANISMS FOR WELLBORE DEVICES

(71) Applicant: Halliburton Energy Services, Inc., Houston, TX (US)

(72) Inventors: Shanu Thottungal Eldho, Singapore (SG); Jalpan P. Dave, Singapore (SG); Ryan T. Humphrey, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 63 days.

(21) Appl. No.: 18/341,500

(22) Filed: Jun. 26, 2023

(65) Prior Publication Data

US 2024/0426190 A1 Dec. 26, 2024

(51) Int. Cl.
*E21B 33/128* (2006.01)
*E21B 23/06* (2006.01)
*E21B 43/26* (2006.01)

(52) U.S. Cl.
CPC ..... *E21B 33/1285* (2013.01); *E21B 23/06* (2013.01); *E21B 43/26* (2013.01)

(58) Field of Classification Search
CPC ..... E21B 33/1285; E21B 23/06
See application file for complete search history.

(56) References Cited

U.S. PATENT DOCUMENTS 4,791,992 A * 12/1988 Greenlee ..... E21B 33/128 166/387
5,810,082 A 9/1998 Jordan, Jr.
6,612,372 B1 * 9/2003 Freiheit ..... E21B 33/1208 166/147
7,631,699 B2 12/2009 Cisneros
8,695,697 B2 * 4/2014 Derby ..... E21B 33/1208 166/147
9,995,111 B2 * 6/2018 Hughes ..... E21B 34/103
2009/0283279 A1 * 11/2009 Patel ..... E21B 33/129 166/382
2012/0012342 A1 1/2012 Wilkin et al.
2016/0115762 A1 4/2016 O'Dwyer et al.
2023/0072189 A1 3/2023 Mothilal et al.
2023/0116346 A1 4/2023 Dave et al.

FOREIGN PATENT DOCUMENTS

CN 118049170 A * 5/2024
WO 2008021703 2/2008

OTHER PUBLICATIONS

"PCT Application No. PCT/US2023/069198, International Search Report and Written Opinion", Mar. 19, 2024, 11 pages.

* cited by examiner

*Primary Examiner* — Matthew R Buck
(74) *Attorney, Agent, or Firm* — DeLizio, Peacock, Lewin & Guerra LLP

(57) ABSTRACT

A packer setting apparatus utilizes a two piston design to set a sealing element of a wellbore packer based on a first level of fluid pressure provided to the packer setting apparatus when positioned downhole within a wellbore. The packer setting apparatus is further configured to maintain the sealing element in the set configuration when the packer setting apparatus is exposed to higher fluid pressure levels that would be experienced as part of wellbore fracturing operation and/or other pressure treatment operations that may be performed on the wellbore where the packer setting apparatus and the sealing element are located.

19 Claims, 8 Drawing Sheets

FIG. 1

ACTIVATION MECHANISMS FOR WELLBORE DEVICES

TECHNICAL FIELD

The disclosure generally relates to the field of downhole fluid injection operations and to activation of a device in a wellbore, including setting packers within a wellbore.

BACKGROUND

Hydraulic fracturing and other operations that may be performed on a subterranean borehole of a wellbore system often entails applying high levels of fluid pressure within a cased or uncased wellbore conduit, into perforations formed through the wellbore conduit, and into a formation surrounding portions of the conduit. As part of these operations, one or more packers may be positioned along the borehole, the one or more packers "set" so that the set packer(s) provide a seal between the wellbore conduit and the formation where the packer is positioned within the borehole. The positioning and setting of the one or more packers is used to create one or more zones, the zones configured to allow a pressurized fluid, such as a fracturing fluid provided within the wellbore conduit, to be applied to certain zones along the borehole while isolating other zones from exposure to the pressurized fluids.

BRIEF DESCRIPTION OF THE DRAWINGS

Embodiments of the disclosure may be better understood by referencing the accompanying drawings.

Figure 1:
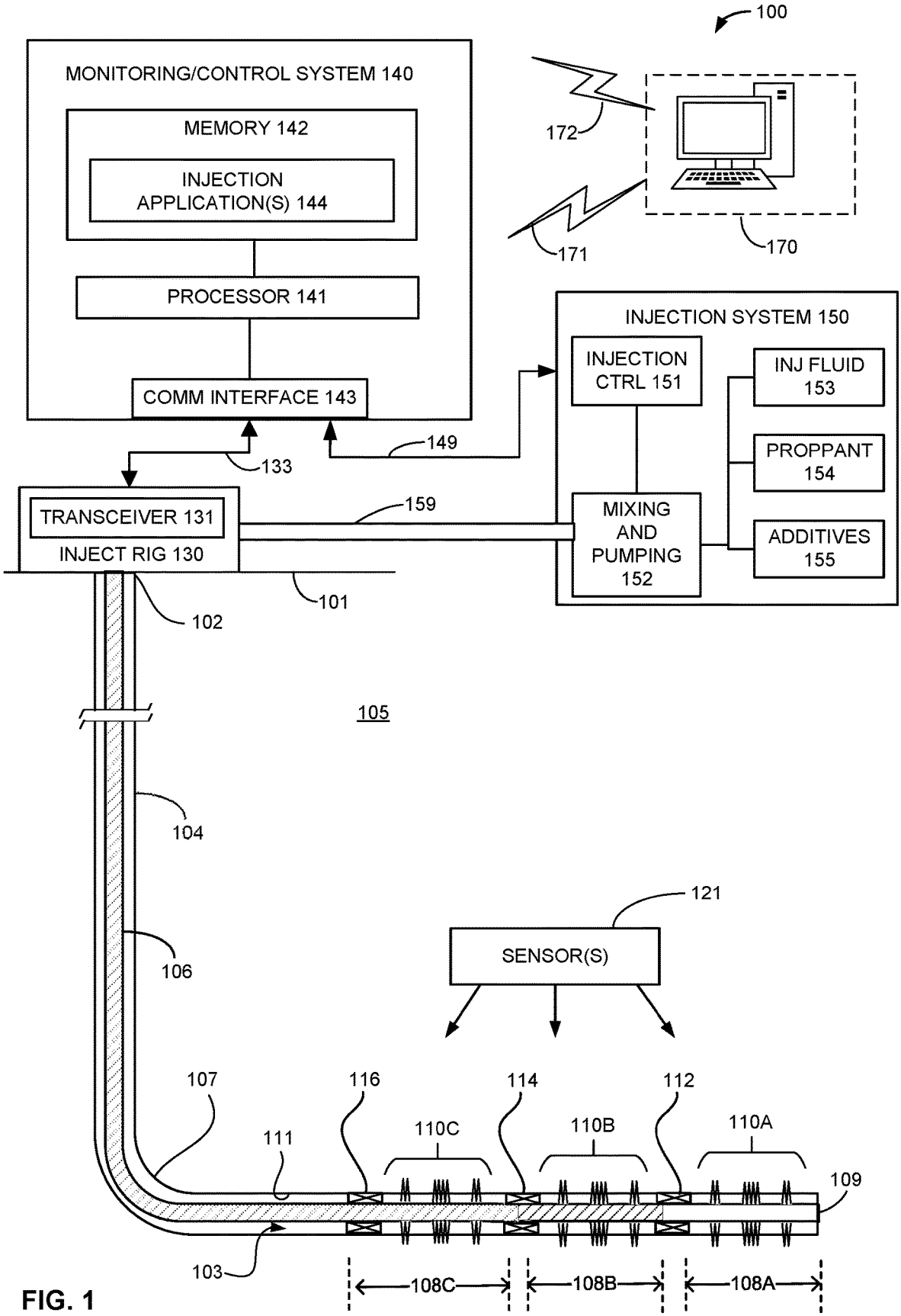
FIG. 1 is a block diagram depicting a well system configured to implement fluid fracturing, injection, and treatment operations in a wellbore in accordance with various embodiments.

The drawings are provided for the purpose of illustrating example embodiments. The scope of the claims and of the disclosure are not necessarily limited to the systems, apparatus, methods, or techniques, or any arrangements thereof, as illustrated in these figures. In the drawings and description that follow like parts are typically marked throughout the specification and drawings with the same or coordinated reference numerals. The drawing figures are not necessarily to scale. Certain features of the invention may be shown to be exaggerated in scale or in somewhat schematic form, and some details of conventional elements may not be shown in the interest of clarity and conciseness.

DETAILED DESCRIPTION

In the following detailed description of the illustrative embodiments, reference is made to the accompanying drawings that form a part hereof. These embodiments are described in sufficient detail to enable those skilled in the art to practice the techniques and methods described herein, and it is understood that other embodiments may be utilized, and that logical structural, mechanical, electrical, and chemical changes may be made without departing from the scope of the disclosure. To avoid detail not necessary to enable those skilled in the art to practice the embodiments described herein, the description may omit certain information known to those skilled in the art. The following detailed description is, therefore, not to be taken in a limiting sense.

The embodiments described herein relate to systems, apparatus, methods, and techniques that may be used for activation of a downhole tool, such as setting one or more packers in a borehole of a wellbore in order to isolate one or more zones within the wellbore. Embodiments of the packer setting apparatus as described herein utilize a dual-piston configuration that can be used to "set" the sealing element of a packer using a first level of fluid pressure provided to the packer setting apparatus, followed by activation of the packer setting apparatus to release a second piston of the packer apparatus from a first piston of the packer apparatus. The activation allows for the packer apparatus to be exposed to a higher level of fluid pressure, for example fluid pressure levels required to perform fracturing operations of the wellbore where the sealing element of the packer apparatus has been set, while reducing the level of force exerted on the sealing member that the sealing member might incur at the higher fluid level pressures without the activation of the second piston.

In the operation of subterranean wellbores, including fracturing operations performed on a wellbore, it is often necessary to set one or more packers at one or more locations along the wellbore in order to isolate sections of the wellbore from one another. Different fluid pressures may be used to set packer(s) into a sealing configuration within the wellbore, while a second and higher fluid pressure or pressure(s) may be applied to the zones of the wellbore that has been isolated by the one or more packers as part of the fracturing or other well treatment operations.

In high pressure fracturing applications, the upper zone packers may see very high pressures (in various embodiments, up to 15,000 pounds per square inch (PSD) or approximately 103,400 kilopascal while the lower zones are being fracked. This can happen multiple times, and may result in too high a setting load being applied into the sealing elements of these upper zone packers. Embodiments of the dual-piston packer setting apparatus as disclosed herein include a dual-piston design such that there are two pistons comprising a primary or first piston and a secondary or second piston. The second piston is initially set up as detachably coupled to the primary piston. Once a packer apparatus including a sealing elements is positioned at a desired location within a borehole, a "setting" fluid pressure is applied to the packer apparatus, which utilizes a force applied to both the primary piston and the secondary piston by the fluid pressure to "set" the sealing element. In various embodiments, "setting" the sealing element includes compressing the sealing element so that the sealing elements expands and forms a seal between the packer apparatus and a portion of formation material that is located adjacent to the packer apparatus. Once the sealing elements has been "set." and upon a fluid pressure level received at the packer apparatus exceeding an activation threshold pressure level, the secondary piston is detached from the primary piston, in some examples by shearing of a shear pin or shear ring, and moves away from the primary piston. In other embodiments, the second piston is coupled to the first piston by a resettable collet that is configured to allow the second piston to be decoupled from and then recoupled to the first piston. After decoupling from the first piston, any forces applied by fluid pressure to the second piston are transferred from the second piston and into a piston mandrel of the packer apparatus instead of into the sealing element. In this way, the sealing element of the packer apparatus is protected from high loads that may result in sealing element damage or failure.

Advantages of the packer apparatus as disclosed herein include the ability of the packer apparatus and the sealing element of the packer apparatus to operate in a high pressure fracturing applications without the need to otherwise isolate the setting chamber (internal cavities of the packer apparatus) from the fluid pressures utilized in the high pressure fracturing operation. Because of the feature of having the secondary piston configured to shear or otherwise move away from the primary piston at an activation fluid pressure level, the dual-piston packer setting apparatus will not apply a much higher setting load into the sealing element which could otherwise damage the sealing element. At the same time, it allows the primary piston to leverage the higher pressures to re-apply a setting load on the elements. This is useful because an injection usually causes a drop in downhole temperature which can cause the sealing element(s) to lose some of its squeeze, and thus level of seal being provided between the sealing element and the formation. With the primary piston leveraging the higher pressure to once again apply a safe amount of setting load on the sealing element(s), the performance of the sealing element(s) can be improved.

Although described throughout this disclose as being utilized to set and maintain a sealing element of a packer in a sealing configuration, embodiments of the dual-piston apparatus as described herein are not limited to packer setting applications only. Other applications of the dual-piston apparatus are contemplated for use in the activation of other types of devices that may require activation based on controlling fluid pressures provided to a downhole tool once the downhole tool has been positioned within a wellbore.

As utilized throughout this disclosure, and unless otherwise described herein, the term "inner surface" refers to a surface or surfaces of a device or an entity that is/are closest in a radial direction to the longitudinal axis of the packer apparatus relative to other parts or portions of the device or entity, and the term "outer surface" refers to a surface or surfaces of a device or an entity that is/are farthest in a radial distance from the longitudinal axis of the packer apparatus relative to other parts or portions of the device or entity. Additional details regarding embodiments of the dual-piston packer setting apparatus are further illustrated and described with respect to FIGS. 2-9. Various methods for operating a wellbore system utilizing the dual-piston packer setting apparatus are illustrated and described with respect to FIGS. 11 and 12.

As utilized throughout this disclosure and unless otherwise described herein, the term "uphole" refers to a direction or an orientation along the longitudinal axis of the packer apparatus that moves toward the wellhead of a wellbore, regardless of whether referring to a vertical, a horizontal, or otherwise deviated orientation for a portion of the wellbore, and the term "downhole" refers to a direction or an orientation along the longitudinal axis of the packer apparatus that moves away from the wellhead of a wellbore and toward a wellbore bottom, regardless of whether referring to a vertical, a horizontal, or otherwise deviated orientation portion of the wellbore.

As utilized throughout this disclosure and unless otherwise described herein, the term "uphole portion" refers to a part or portion of a device or an entity (including a cavity), which is closest to the wellhead following a path along the longitudinal axis extending through the packer apparatus relative to other parts or portions of the device or entity, and the term "downhole portion" refers to a part or portion of a device or an entity (including a cavity), which is closest to the bottom or end of a wellbore following a path along the longitudinal axis extending through the packer apparatus relative to other parts or portions of the device or entity. The terms "packer setting apparatus" and "packer apparatus" may be used interchangeably throughout this disclosure to refer to embodiments of the dual-piston packer setting apparatus as illustrated and described in this disclosure.

FIG. 1 is a block diagram depicting a well system 100 configured to implement fluid fracturing, injection, and treatment operations in a wellbore in accordance with various embodiments. Well system 100 includes sub-systems, devices, and components configured to implement multi-stage fluid injection operations, such as hydraulic fracturing operations, gravel packing operations, and/or other wellbore treatment operations within a wellbore 104. In the embodiment depicted in FIG. 1, well system 100 includes an injection rig 130 positioned over or proximate to the wellhead 102 of wellbore 104 at surface 101. Well system 100 further includes an injection system 150 configured to mix and provide to the injection rig 130 an injection fluid for use in the fracturing and/or fluid treatment operations to be performed on wellbore 104. Well system 100 also includes a monitoring/control system 140 configured to provide control over the fluid injection operations being performed on wellbore 104, as further described below.

Wellbore 104 in the depicted embodiment of FIG. 1 comprises a borehole extending into formation 105, the wellbore including a vertical portion of the wellbore extending from surface 101 to a curve 107, and a horizontal portion of the wellbore extending horizontally from curve 107 to the wellbore bottom 109. Although depicted in FIG. 1 as having a vertically oriented portion and a horizontally oriented portion of the wellbore, embodiments of system 100 may include other configurations of wellbores having vertical, horizontal, and/or non-vertical and non-horizontal orientations for boreholes in some combination. Further, although system 100 is depicted in FIG. 1 as being included in an entirely land based configuration, embodiments of the packer apparatus disclosed herein may also be utilized in offshore system configurations wherein the wellbore is located below a body of water, such as the ocean or a lake.

System 100 further includes a conduit 106 that extends through wellbore 104 to a location that is at or near the wellbore bottom 109. Conduit 106 may be formed as a series of pipes or casings that are joined together to form a fluid passageway extending within the conduit, and coupled at the surface 101 to injection rig 130. The fluid passageway formed by conduit 106 may be configured to provide one or more fluids, for example fluids provided to the conduit 106 from injection rig 130 and from injection system 150.

As illustrated in FIG. 1, the conduit 106 of system 100 includes a plurality of packer setting apparatus 112, 114, and 116. Packer setting apparatus 112 is provided along conduit 106 at a first distance uphole from wellbore bottom 109, and defines a first zone 108A along the wellbore 104. Packer setting apparatus 114 is provided along conduit 106 at a distance uphole from packer setting apparatus 112, and defines a second zone 108B along the wellbore 104. Packer setting apparatus 116 is provided along conduit 106 at a distance uphole from packer setting apparatus 114, and defines a third zone 108C along wellbore 104.

Embodiments of system 100 may include more or less packer apparatus compared to the three packer apparatus as illustrated in FIG. 1, and therefore may include more or less zones defined along the wellbore 104 based on the actual number of packer apparatus included along conduit 106. Further, while depicted in FIG. 1 as having each of zones 108A, 108B, and 108C comprising a relatively equal length longitudinally along the conduit 106, it would be understood that each zone may have a length longitudinally along the conduit that is a different length compared to a length of one or more of the other zones defined along the conduit.

In various embodiments, one or more of the packer apparatus 112, 114, and 116 may be an embodiment of the packer apparatus 200 illustrated and described herein with respect to FIGS. 2-6, or some equivalent thereof. In various embodiments, one or more of the packer apparatus 112, 114, and 116 may be an embodiment of the packer apparatus 700 illustrated and described herein with respect to FIGS. 7-9, or some equivalent thereof. Packer apparatus 112, 114, and 116 may be incorporated into conduit 106, and delivered to the respective positions illustrated in FIG. 1 for each of these packer apparatus by the advancement of the conduit 106 through the wellbore 104.

A diameter in cross-section of conduit 106 is smaller than a diameter in cross section of the wellbore 104, resulting in an annulus 103 extending along and outside of the conduit 106 between the conduit and the inner wall 111 of the wellbore. In various embodiments, each of packer apparatus 112, 114, and 116 encircle a respective portion of the conduit 106 for a length along the longitudinal axis of the conduit, and are initially advanced through the wellbore 104 in an "unset" configuration, wherein an outside diameter of the packer apparatus in cross-section is smaller than the diameter of the borehole of the wellbore 104.

Once positioned in the desired location within the wellbore 104, the packer apparatus, such as packer apparatus 112, 114, 116, may be "set" in place. When in the "set" configuration a sealing element included as part of the packer apparatus is expanded so as to form a hydraulic seal between the conduit 106 where the packer apparatus is located and the inner wall 111 of formation 105 in the area adjacent to the extended sealing element. When in the "set" configuration, the extended sealing element of a packer apparatus is configured to hydraulically isolates a portion of the annulus 103 that is uphole from the extended sealing element from a portion of the annulus 103 that is downhole from the extended sealing element. By way of example, when packer apparatus 112 is configured in the "set" configuration, the portion of annulus 103, including at least the portion of annulus 103 included in zone 108B, is hydraulically isolated from the portion of annulus 103 that is located downhole from packer apparatus 112.

By way of another example, when packer apparatus 114 is configured in the "set" configuration, the portion of annulus 103, including at least the portion of annulus 103 included in zone 108C, is hydraulically isolated from the portion of annulus 103 that is located downhole from packer apparatus 114, which may be limited to the portion of annulus 103 included in zone 108B if packer apparatus 112 is also in a "set" configuration. By way of a further example, when packer apparatus 116 is configured in the "set" configuration, the portion of annulus 103, in some embodiments the portion of annulus 103 extending uphole from packer apparatus 116 to surface 101, is hydraulically isolated from the portion of annulus 103 that is located downhole from packer apparatus 116, which may be limited to the portion of annulus 103 included in zone 108C if packer apparatus 114 is also in a "set" configuration. In this manner, a plurality of zones, such as zones 108A, 108B, and 108C, may be established to isolated portions of annulus 103 from one another using the packer apparatus, while maintaining a fluid communication between all of the zones though the fluid passageway provided by conduit 106.

One of the key advantages of maintaining the fluid communication through conduit 106 to all of the packer apparatus is that, by utilizing the dual-piston packer apparatus as described herein, each of the packer apparatus can be configured to move from the "unset" configuration into the "set" configuration by providing a fluid within with conduit 106 that is within a predetermined fluid pressure range and that is configured to set each of the packer apparatus without damaging the sealing elements utilized by the packer apparatus to form the hydraulic seal, and thus the isolation of the different portions of the annulus surrounding the conduit. Once the packer apparatus have been configured to the "set" configuration, individual zones, such as zones 108A, 108B, and 108C, may be exposed to higher levels of fluid pressures delivered through conduit 106 that are needed to perform operations, such as fracturing operations, on these zone(s). These higher fluid pressures are also received at the packer apparatus, and would normally be potentially damaging to the sealing elements of the packer apparatus. However, the dual-piston packer apparatus as described herein provide a further mechanism in the form of a releasable second piston, that, when activated by the higher fluid pressure levels received at a packer apparatus during or prior to one of these fracturing procedures, reduces the overall force that would otherwise be applied to the sealing element, and thereby allows the sealing element of each of the packer apparatus to operate properly and to not incur damage to the sealing element despite the higher pressure levels being provided through the conduit 106.

A given one of the packer apparatus may be exposed to these higher levels of fluid pressure required for example to perform a fracturing operation because the packer apparatus is located uphole from a zone along the conduit that is being fractured, but has not yet been isolated from the higher fluid pressure being provided by the conduit due to the need to still perform some level of fracturing on the zone being defined by the given packer apparatus. For example, in embodiments of system 100 as shown in FIG. 1, packer apparatus 112, 114, and 116 may have all be "set," providing isolation between the portion of annulus 103 extending across zones 108A, 108B, and 108C, respectively.

In operation, conduit 106 may be advanced into the wellbore 104 to a position as shown in FIG. 1, and including packer apparatus 112, 114, 116. A fluid pressure having a fluid pressure level within the packer setting pressure range is applied to the column of fluid present within conduit 106. A fluid pressure within the packer setting pressure range is a fluid pressure having a minimum pressure level adequate to cause packer apparatus to "set," including applying a force to a first piston and a second piston included in the respective packer apparatus, but also a fluid pressure level that is below the pressure level required to activate the second piston by, in some embodiments, shearing a device, such as a shear pin or a shear ring, that mechanically couples the second piston to the first piston when the packer apparatus is in both the "unset" and the "set" configurations.

After setting the packer apparatus, and for hydraulic fracturing operations, system 100 proceeds to a fracturing and/or wellbore treatment phase. As part of the fracturing or other wellbore treatment operations, system 100 may be operated to controllably provide fluid communication between the fluid pressure being applied within conduit 106 and one or more perforation clusters 110A, 110B, and 110C provided along conduit 106. As shown in FIG. 1, a first set of perforation clusters 110A extends along conduit 106 within zone 108A, a second set of perforation clusters 110B extent along conduit 106 within zone 108B, and a third set of perforation clusters 110C extend along conduit 106 within zone 108A. In various embodiments, each set of the perforation clusters are provided prior to positioning conduit 106 within wellbore 104, and are initially configured in a closed configuration, for example using controllable sleeves, which seal off the respective openings of the perforation clusters. The mechanisms, such as the controllable sleeves used to seal off the perforation clusters, may be controlled, for example using drop balls or by other control mechanisms, to allow the individual sets of perforation clusters to be uncovered and thereby provide fluid communication between the particular zone were the perforation cluster is located and the area outside of conduit 106 that is adjacent to the now opened perforation clusters. Once opened, the perforation clusters allow pressurized fluid provided within conduit 106 to exit the conduit through the openings of the perforation clusters and be in fluid communication with the portion of the formation 105 within the zone where the perforation clusters are located, allowing a fracturing and/or other wellbore treatment operation(s) to be performed on that portion of the wellbore.

By way of example, after setting the sealing elements of the packer setting apparatus 112, 114, and 116, the set of perforation clusters 110A associated with zone 108A may be activated so that the opening of the perforation clusters 110A provide fluid communication between the fluid present in conduit 106 and the annulus 103 of the wellbore. The perforation clusters 110B associated with zone 108B and the perforation clusters 110C associated with zone 108C may remain closed. A fracturing and/or other wellbore treatment operations may now be performed on zone 108A by apply higher levels of fluid pressure through conduit 106 that are received and zone 108A, and communicated out through perforation clusters 110A to the portion of annulus 103 adjacent to zone 108A, as represented by the non-cross-hatched portion of conduit 106 extending along zone 108A. During this process, at least packer setting apparatus 114 and 116 will be exposed to the higher fluid pressure levels required as part of the operations being performed on zone 108A. However, the design of the dual-piston packer apparatus as disclosed herein is configured to "activate" the second piston at these higher fluid pressures to mechanically disconnect the second piston from the first piston, and allow the second piston to be positioned so that any fluid pressure applied to the second piston is no longer transmitted to the sealing element included in the packer apparatus. By removing the force being applied to the second piston from being transferred to the sealing element, the level of force applied by only the first piston at the higher fracturing pressure levels protects the sealing element of the packer apparatus from damage, while allowing the sealing element to maintain the hydraulic seal between the conduit and the adjacent formation. This can be especially useful because a fracturing operation typically cools down the downhole temperature which can cause the sealing elements 114 and 116 to lose some of its energy. The use of the dual-piston arrangement as disclosed herein also avoids the need to add devices and mechanisms the would otherwise be required to isolate the first piston and the second piston from the higher levels of fluid pressures that are being applied through conduit 106 as part of a fracturing procedure, thus reducing the overall cost and complexity of the packer apparatus while still allowing the packer apparatus to operate when exposed to the higher level of fluid pressures utilized in a fracturing operation.

In further operation of system 100, according to various embodiments, upon completion of the fracturing operations needed to be performed on zone 108A, a blocking device, such as a drop ball, may be feed down through conduit 106, the drop ball designed, for example by using a particular size ball, to engage the packer apparatus 112 in a manner that hydraulically isolates the uphole portion of the interior fluid passageway of conduit 106 from the portion of the fluid passageway within conduit 106 that is located downhole from packer apparatus 112. In addition, this drop ball may be configured to open a set of perforation clusters 110B extending along zone 108B of conduit 106. With the perforation clusters 110B opened, a fracturing and/or other wellbore treatment procedures may proceed on zone 108B by providing a fracturing fluid at a fracturing fluid pressure levels though the interior fluid passageway of conduit 106. During this procedure, zone 108A is protected by the drop ball positioned at packer apparatus 112, as represented by the "clear" rendering in FIG. 1 of the portion of the interior fluid passageway of conduit 106 that is downhole of packer apparatus 112, while the portions of the interior fluid passageway of conduit 106 that are located uphole from packer apparatus 112 are rendered in crosshatch in FIG. 1. As shown in FIG. 1, at least packer apparatus 116 is exposed to the higher level(s) of fluid pressure being utilized to perform the fracturing operations on zone 108B. However, because of the use of the dual-piston configurations in these packer setting apparatus, the second piston in packer setting apparatus 116 is activated to remove any forces applies to the second piston from being transferred to the sealing element associated with packer setting apparatus 116. Thus, the sealing element of packer setting apparatus 116 is again protected from being exposed to levels of force that could damage the sealing element, and potentially result in failure of the hydraulic seal, despite being exposed to the higher levels of fluid pressure being applied to conduit 106 as part of the fracturing operation.

As would be understood based on review of FIG. 1 and the above description, additional drop balls could be advanced through conduit 106, each of the drop balls designed to seal off a downhole portion of the interior fluid passageway of conduit 106, to allow for additional perforation clusters, such as perforation clusters 110C, to be opened so that addition fracturing operations to be performed on other zones, such as zone 108C within the wellbore, while protecting the sealing elements of any of the packer apparatus being exposed to the higher levels of fluid pressure utilized during these procedures.

In various embodiments of system 100, injection rig 130 includes components for configuring and controlling deployment of fluid injection components within wellbore 104. For example, injection rig 130 may be configured to deploy one or more drop balls, as described above, sequentially to seal off portions of the fluid passageway extending through conduit 106. Further, injection rig is configured to receive various fluids from injection system 150, for example through conduit 159, and to transfer the various fluids to the fluid passageway extending through conduit 106.

Embodiments of well system 100 as illustrated in FIG. 1 includes a monitoring/control system 140, an injection system 150, and a user interface 170. Monitoring/control system 140 may operate above surface 101, and within or proximate to injection rig 130 in various embodiments. Monitoring/control system 140 comprises, in part, one or more computer processors 141, and one or more computer memory devices 142, which together are configured to store and execute program instructions for monitoring and controlling the overall fluid treatment procedures that are to be or that are being performed on a wellbore, such as wellbore 104. In various embodiments, memory 142 of the monitoring/control system 140 includes one or more programs, instructions, parameters, thresholds values, and/or other data, in the form of one or more injection applications 144, that may be utilized by the one or more processors 141 to execute instructions designed to monitor and control the fluid treatment procedure(s) to be or that are being performed on wellbore 104.

Monitoring/control system 140 is communicatively coupled to injection system 150 via a communication link, such as communication link 149. Communication link 149 is not limited to any particular type of communication link, and may include any type or combination of devices, such as bus systems, electrical cabling, and/or wireless communication devices that allow for electronic communication to occur between the monitoring/control system 140 and one or more devices of the injection system 150, including but not limited communications with the injection controller 151 included in the injection system 150. In various embodiments, monitoring/control system 140 is configured to execute programs, for example a program comprising a set of parameters for dictating a particular fluid treatment process, which includes generating instructions that are communicated to the injection system 150 in order to control the operation of the injection system for providing treatment fluid(s) to the injection rig 130 based on the desired fluid treatment process to be performed on the wellbore 104. Control of the operation of the injection system includes controlling the levels of fluid pressures provided within conduit 106 in order to control the setting and the activation of the packer setting apparatus, such as packer setting apparatus 112, 114, and 116, which are provided downhole along conduit 106.

In various embodiments, based on instructions received from the monitoring/control system 140, injection system 150 may be configured to provide a prescribed type or mixture of fluid, for example through fluid conduit 159, to the injection rig 130 for injection into wellbore 104. The instructions provided to injection system 150 may include instruction regarding various parameters related to the fluid (s) to be injected into the wellbore, the pressure(s) and/or pressure profiles hat are to be used to inject the fluid during the fluid treatment process, and/or instructions related to the flow rate(s) at which the fluid being used during the fluid treatment process are to be provided to the injection rig 130. In various embodiments, monitoring/control system 140 may provide instructions to injection system 150 related to operation of specific devices, such as the operation of valves and/or related to the use of pump(s), such as the number of pumps be utilized at any given stage of a particular fluid treatment operation. In various embodiments, one or more components included within injection system 150, such as injection controller 151, may receive instructions from monitor/control system 140, and based on the received instructions, may make further determinations related to the operation of the devices, such as the valves and/or pumps, which are included in injection system 150 and that are being utilized to carry out a fluid treatment operation. In various embodiments, injection system 150 may communicate information back to monitoring/control system 140, such as a confirmation of receipt of instructions provided from the monitoring/control system, information related to the status of the mixing and/or fluid operations being performed by the injection system 150, and/or any error or warning messages that might relate to issues, such as failed components, which might be detected by or within the injection system 150.

Injection system 150 includes various components and devices configured to provide a desired mixture of fluid components to the injection rig 130 for injection into wellbore 104 as part of a fracturing or fluid stimulation procedure. As illustrated in FIG. 1, injection system 150 includes sources for a plurality of fluid components, such as injection fluid 153, proppant 154, and additives 155. Injection fluid 153 may comprise a fluid, such as water, brine, carbon dioxide, or nitrogen, used to provide the bulk of the fluid that is injected into wellbore 104 for a fracturing process. Proppant 154 may comprise material such as sand or ceramic beads, used in combination with the injection fluid to increase the permeability of the formation. Additives 155 are not limited to any particular type of additive, and may include such materials as gelling agents, friction reducers, bactericides, permeability modifiers, foaming agent, and corrosion inhibitors. Additives may be added to the injection fluid 153 in order to alter and/or control a particular property, such as a chemical or physical property, of the injection fluid prior to the injection fluid being utilized in a fracturing or other treatment operation being performed on wellbore 104. In various embodiments, the fluid produced/provided by the injection system is a solids-free fluid, which means it has a turbidity measurement of less than 1000 Formazin Nephelometric Units (FNU). In various embodiments, the fluid produced/provided by the injection system 150 may have a very low drilling mud content or may be drilling mud free.

Embodiments of injection system 150 includes a mixing and pumping unit (unit) 152. Unit 152 may be in fluid communication with each of the sources of injection fluid 153, proppant 154, and additives 155. Unit 152 includes valving, manifolds, flow control valves, or other devices that allows the unit to controllable combine, in a desired proportion, the mixture of injection fluid, proppant, and/or additives to formulate a desired blend of material to be provided to injection rig 130 for injection into wellbore 104 as part of a fracturing or stimulation treatment being performed on wellbore 104. Unit 152 includes one or more pumps that may draw fluid and/or materials from any the sources of injection fluid 153, proppant 154, and/or additives 155. Unit 152 may include one or more pumps configured to provide the fluid pressure needed to cause the treatment fluid mixed at unit 152 to flow to the injection rig 130, for example through fluid conduit 159. In various embodiments, unit 152 also includes one or more pumps configured to provide the required level of fluid pressure, for example through fluid conduits coupling fluid conduit 159 to the wellbore 104 through injection rig 130, that is needed to pressurize the fluid present in conduit 106 within the wellbore to a desired pressure level as part of setting the sealing elements of the packer setting apparatus, activating the packer setting apparatus to release the second piston from the first piston within the packer apparatus, and for performing fracturing or stimulation treatment operations being performed on the wellbore. In various embodiments, unit 152 may also be in fluid communication with a waste reservoir 156, such as a waste tank or waste pit, wherein unit 152 is configured to pump fluid from wellbore 104 back through fluid conduit 159, or an alternative fluid conduit (not shown in FIG. 1), and into waste reservoir 156, for example to relieve fluid pressure on the fluid column within conduit 106 following completion of a fracturing or stimulation treatment procedure.

Embodiments of injection system 150 may or may not include an injection controller 151. Injection controller 151 when provided may be coupled through communication link 149 with monitoring/control system 140. In various embodiments, injection controller 151 is configured to provide control signals to unit 152 to control the operation of the valves, manifolds, and/or pumps included in unit 152 in order to control the mixing process of the fluid being prepared for injection into wellbore 104, and/or to control the operator of the one or more pumps included in unit 152 in order to control the pressure and/or the flow rate of the treatment fluid being provided to injection rig 130 as part of a fracturing or stimulation treatment being performed on the wellbore 104. In various embodiments, injection controller 151 receives control signals from the monitoring/control system 140 based on outputs provided by injection application 144, which are configured to be used by injection controller 151 to operate unit 152 in order to provide the desire fluid mixture and/or the desired fluid pressures and flow rates as part of a planned fluid injection operation. In embodiments that do not include injection controller 151, one or more processors 141 of the monitoring/control system 140 may provide control signals, for example via communication link 149, that are configured to directly control the operations of the devices included in injection system 150, such as unit 152. In such embodiments, devices included in injection system 150 may be configured to provide output signals, for example output signals from one or more sensors, which are communicated to the monitoring/control system 140, for example via communication link 149. The monitoring/control system 140 may be configured to receive these output signals, and provide the desired control over the injection system 150 based at least in part on these output signals received from the injection system.

One or more sensors 121 may be located at various location downhole within wellbore 104, and may be configured to communicate with one or more other devices within wellbore 104 and/or one or more devices located above surface 101, such as injection rig 130 and/or monitoring/control system 140. In various embodiments, the sensors 121 include or are coupled with a fluid signal generator configured to produce fluid signals that are induced into the conduit 106, and thus travel from the source of the fluid signals through the pressurized conduit 106 to one or more other devices. For example, injection rig 130 may include a transceiver 131 that may comprise a sensor, such as an acoustic sensor, which is configured to detect the fluid signal being transmitted through the conduit 106. The transceiver 131 may, based on the detected fluid signals, generate an output signal, which corresponds to the data and/or any information included in the fluid signal, and communicate the output signal to monitoring/control system 140 via communication link 133. In various embodiments, monitoring/control system 140 includes a communication interface 143 that is configured to receive the signals sent from transceiver 131 over communication link 133. Communication link 133 is not limited to any particular type of communication link, and may include any type of bus, electrical cabling, and/or wireless communication devices configured to transmit signal between injection rig 130 and monitoring/control system 140.

Embodiments of well system 100 may include a user interface device, as illustratively represented in FIG. 1 by user interface 170. User interface 170 may include a personal computer, a lap-top computer, or some other type of user interface device, such as a smart phone. In various embodiments, user interface 170 includes a display device, such as a monitor, which is configured to provide visual display of data and other information related to well system 100 and/or to a fluid treatment process being performed on or modeled for wellbore 104. Computer system may include one or more input devices, such as a keyboard, computer mouse, and/or a touch screen that allow a user, such as a technician or engineer, to provide inputs to user interface 170, which may include requests for information regarding the status of well system 100 and/or inputs that may be used to direct the fluid treatment procedures being or to be performed on wellbore 104. Connections between user interface 170 and other devices included in in well system 100 may be provided by wired and/or wireless communication connection(s), as illustratively represented by lightning bolt 171. Connections between user interface 170 and other devices not included in in well system 100 (not shown in FIG. 1), such as databases, servers, and/or other computer devices, may be provided by wired and/or wireless communication connection(s), as illustratively represented by lightning bolt 172.

Figure 2:
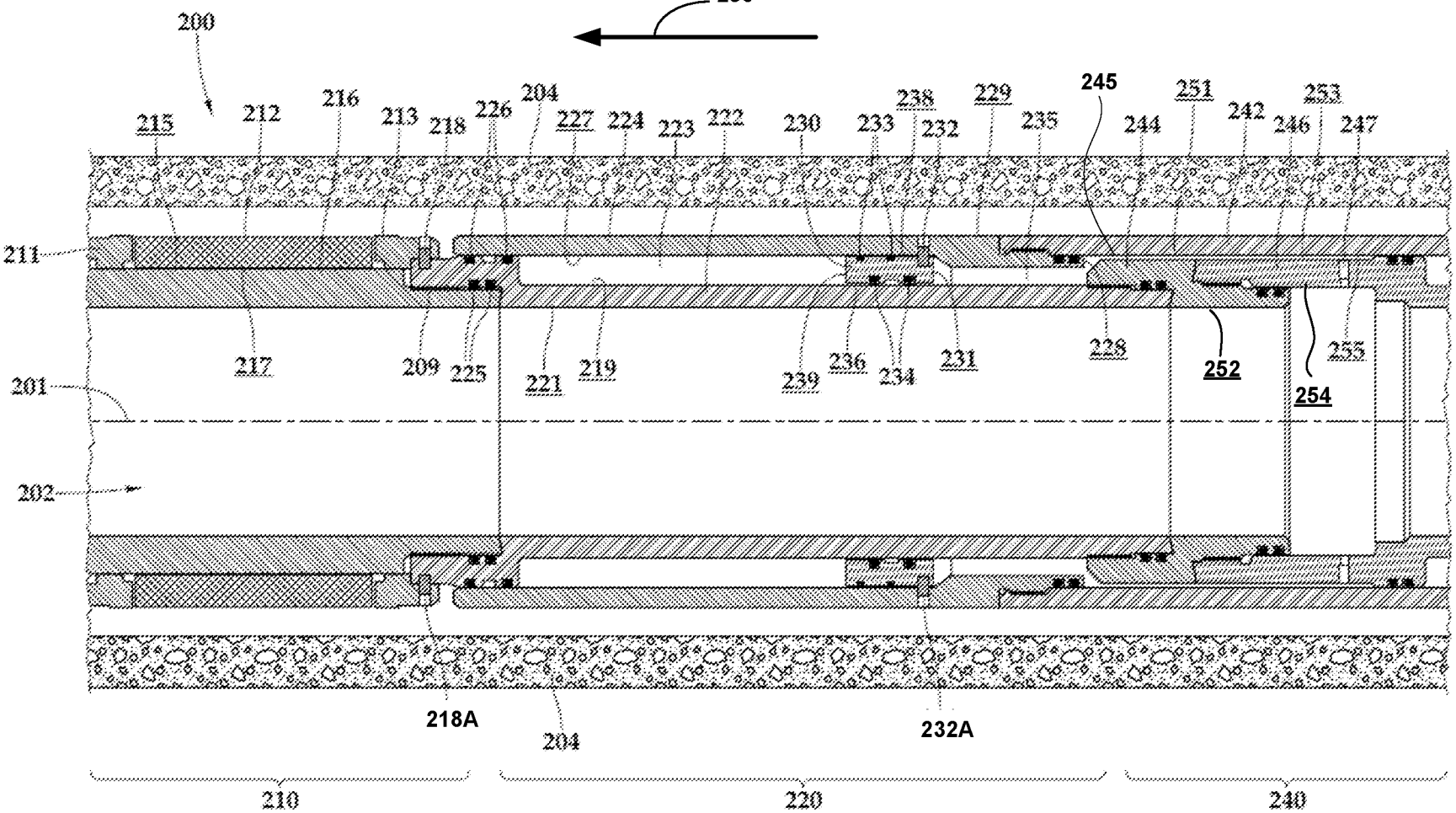
FIG. 2 is a cross-sectional diagram illustrating a packer setting apparatus in an unset initial configuration, in accordance with various embodiments.

FIG. 2 is a cross-sectional diagram illustrating a packer setting apparatus 200 in an unset initial configuration, in accordance with various embodiments. Embodiments of apparatus 200 may include a seal section 210 coupled to and adjacent to a piston section 220, wherein the piston section 220 is coupled to and adjacent a fluid communication section 240, all with respect to a longitudinal axis 201 of the apparatus 200. In FIG. 2 references to "uphole" are positions more toward the left-hand side of the figure or a left-hand portion of a device or entity (such as a cavity), and references to "downhole" refer to positions or portions of a device or entity more toward the right-hand side of the figure. However, embodiments of the apparatus 200 as illustrated in FIG. 2 are not limited to the uphole versus downhole overall orientations as shown in the figure, and may be arranged having components of the apparatus 200 arranged in a 180 degree orientation relative to the longitudinal axis compared to the orientation as shown in FIG. 2 as long as the overall functional relationship between the components is maintained.

Embodiments of the sealing section 210 of apparatus 200 include a sealing element mandrel 216 encircling and enclosing a portion of fluid passageway 202 extending along a length of the longitudinal axis 201. A sealing element 212 encircles the sealing element mandrel 216. In various embodiments, sealing element 212 is formed from an elastic and compressible material, such as rubber. Sealing element 212 includes an inner surface 215 that encircles and is in physical contact with an outer surface 217 of the sealing element mandrel. A first retainer 211 is positioned on the uphole side of sealing element 212, the first retainer encircling a portion of the sealing element mandrel 216, and is fixed in position longitudinally relative to the sealing element mandrel. A second retainer 213 is positioned on the downhole side of the sealing element 212, the second retainer encircling a portion of the sealing element mandrel 216, and is configured to be movable longitudinally relative to the sealing element mandrel when not pinned or otherwise mechanically coupled to the piston mandrel 222 of the piston section 220, as further described below. In various embodiments, the sealing element mandrel 216, the first retainer 211, and the second retainer 213 are each formed from a rigid material, such as metal, for example steel or stainless steel. Although shown as a single piece in FIG. 1, in various embodiments the sealing element 212 may comprise multiple individual sealing elements, each arranged to encircle the sealing element mandrel 216 and arranged between the first retainer 211 and the second retainer 213.

Embodiments of piston section 220 of apparatus 200 include a piston mandrel 222 encircling and enclosing a portion of the fluid passageway 202 along a length of the longitudinal axis 201. An inner surface 221 of piston mandrel 222 forms a portion of the fluid passageway 202 extending from the seal section 210 to the fluid communication section 240 of the packer apparatus 200. An outer surface 219 of piston mandrel 222 forms in inner side wall of cavity 223. The uphole end of piston mandrel 222 includes stop-step 209, which overlaps and is mechanically coupled to the downhole end of sealing element mandrel 216. One or more seals 225 may also be used to seal a joint between piston mandrel 222 and sealing element mandrel 216. A downhole side of stop-step 209 also forms a downhole end seal for cavity 223. In addition, as shown in FIG. 2 second retainer 213 is mechanically coupled to stop-step 209 by shear pin 218. As such, when in the configuration as shown in FIG. 2, second retainer 213 is fixed in position relative to stop-step 209 by shear pin 218.

Embodiments of piston section 220 of apparatus 200 include a first piston 224. An uphole portion of first piston 224 extends to the stop-step 209 of piston mandrel 222, wherein a central portion of first piston encircles and encloses a portion of cavity 223. The uphole portion of first piston 224 overlaps and is sealingly coupled to stop-step 209 by one or more seals 226, which are configured to maintain a fluid seal within cavity 235 while allowing the uphole portion of the first piston to advance over the stop-step 209 in a direction toward second retainer 213 and sealing element 212. The central portion of first piston 224 is also mechanically coupled to second piston 230 by shear pin 232. Second piston 230 includes an inner surface 236 positioned adjacent to the outer surface 219 of piston mandrel 222 and sealingly coupled to the outer surface of piston mandrel 222 by one or more seals 234. Second piston 230 includes an outer surface 238 positioned adjacent to the inner surface 227 of the first piston 224, and sealingly coupled to the inner surface 227 of the first piston by one or more seals 233. The uphole surface 239 of second piston 230 forms the downhole end of cavity 223, while the downhole surface 231 of the second piston forms the uphole end of cavity 235. As such, second piston 230 is configured to provide a hydraulic seal between cavity 223 and cavity 235. A downhole portion of first piston 224 is mechanically coupled to an uphole portion of outer cover sleeve 242, the outer cover sleeve further described below with respect to the fluid communication section 240. An outer surface 229 of first piston 224 extends along the outside surface of the packer apparatus 200. In various embodiments, piston mandrel 222, first piston 224, and second piston 230 are each formed from a rigid material, such as metal, for example steel or stainless steel. Any of the seals 226, 225, 233, and 234 may be formed from an elastic material such as rubber. In various embodiments, one or more of the seals in any of these groups of seals may comprise a sealing ring made of metal such as spring steel or stainless steel.

Embodiments of the fluid communication section 240 of apparatus 200 include a coupler 244, a collar 246, and an outer cover sleeve 242. As shown in FIG. 2, an inner surface 252 of coupler 244 encircles and encloses a portion of fluid passageway 202 along a length of longitudinal axis 201. The uphole end of coupler 244 is mechanically coupled with the downhole portion of piston mandrel 222. The downhole portion of coupler 244 is mechanically coupled to an uphole portion of collar 246. An inner surface 254 of collar 246 encircles and encloses a portion of the fluid passageway 202 along a length of longitudinal axis 201. An outer surface 251 of coupler 244, along with an outer surface 253 of collar 246, form an inner wall of a cavity 245. Outer cover sleeve 242 is mechanically coupled to the downhole portion of first piston 224, and extends in a downhole direction over coupler 244 and collar 246. An inner surface 255 of outer cover sleeve 242 forms an outer wall of cavity 245. As such, cavity 245 extents along the outer surfaces of both coupler 244 and the collar 246 to provide a passageway between cavity 235 and a fluid port 247 providing a fluid passageway through the wall of collar 246 between cavity 245 and the fluid passageway 202 extending through the conduit 106. The uphole end of cavity 245 extends to and is in fluid communication with cavity 235. As such, fluid pressure provided within fluid passageway 202 may be communicated through fluid port 247, to cavity 245 and cavity 235, and apply fluid pressure to portions of first piston 224, including downhole surface 228 of the first piston, and to second piston 230, including downhole surface 231 of the second piston. This fluid pressure as applied to the first piston 224 and the second piston 230 urge this dual-piston arrangement in the direction toward second retainer 213 and sealing element 212. However, when in the "unset" configuration as shown in FIG. 2, shear pin 218 prevents second retainer 213 from moving, for example in the direction of the sealing element 212, and thus allows the sealing elements to remain in the "unset" and thus the extended configuration as illustrated in FIG. 2.

When configured as illustrated in FIG. 2, apparatus 200 may be positioned within a borehole of a wellbore at a location within the borehole where the sealing element 212 is to be set in order to form a seal between the sealing section 210 of the apparatus and a formation, such as formation 204. Once at the desired position for setting the sealing element 212, a fluid pressure provided by a fluid provided in fluid passageway 202 is received at fluid port 247. The level of fluid pressure generated within the fluid passageway 202 and received at fluid port 247 is a level of fluid pressure that exceeds a minimum setting pressure threshold for setting the sealing element 212 in order to from a hydraulic seal between the sealing element 212 of the packer apparatus and the formation 204 that is adjacent to the sealing element, while being less than a minimum activation threshold pressure level required to actuate the second piston 230 to be released from being mechanically coupled at a fixed position relative to first piston 224.

When a fluid pressure that falls within the seal setting pressure range is received at fluid port 247, the fluid pressure is provided through cavity 245 and on into cavity 235 within the piston section 220. Fluid pressure present within cavity 235 will operated on downhole surface 228 of first piston 224, and also on downhole surface 231 of second piston 230. The resultant forces acting on the first piston 224 will urge the first piston in a direction indicated by arrow 250, and bring the uphole portion of the first piston into contact with second retainer 213. Further, the resultant forces acting on downhole surface 231 of second piston 230 will urge the second piston in this same direction as indicated by arrow 250. Because the level of force exerted on second piston 230 by a fluid pressure within the seal seating pressure range is does not exceed a minimum level of fluid pressure required to shear the shear pin 232 coupling the second piston to the first piston, the second piston remains mechanically coupled to the first piston, and any forces exerted on the second piston as a result of the fluid pressure present in cavity 235 is transferred through pin 232 to the first piston.

The combined forces applied to the first piston 224 and second piston 230 by the fluid pressure present in cavity 235 are calculated to be and are adequate to move the uphole portion of the first piston to contact second retainer 213, and to apply adequate force to shear pin 218 through the second retainer to shear the shear pin. Once pin 218 has been sheared, the continued application of force applied to the first piston and to the second piston by the fluid pressure present in cavity 235 moves the first piston and the second piston further in the direction indicated by arrow 250, allowing the movement to drive second retainer 213 in the uphole direction. The movement of second retainer 213 in the uphole direction compresses sealing element 212 against the fixed position of first retainer 211, which in turn extends the outward facing surface the sealing element in a direction away from sealing element mandrel 216 and into contact with the formation 204 that is located adjacent to the sealing element. Movement of the first piston 224 in the uphole direction as described above is accompanied by associated movement of the outer cover sleeve 242 so that the integrity of the cavity 245 and the integrity of cavity 235 are maintained despite the uphole movement of the first piston and the second piston.

The continued application of fluid pressure within the fluid passageway 202 at a level within the fluid seal setting pressure range will continue to urge and/or hold the first piston 224, the second piston 230, and the second retainer 213 in a position that maintains the sealing element in contact with and forming a hydraulic seal with formation 204. In the alternative or in addition, a portion of outer cover sleeve 242 may be configured to engage a retention mechanism (not shown in FIG. 2), such as a mechanical latch or ratcheting mechanism, which is configured to prevent backward movements of the first piston 224 and the outer cover sleeve 242 in the downhole direction relative to any uphole movement of these devices resulting from the setting of the sealing element 212. Upon the shearing of shear pin 218 and the compression of sealing element 212 to form a hydraulic seal between the apparatus 200 and formation 204, the apparatus assumes a "set" configuration as illustrated and described below with respect to FIG. 3.

Although described above as having shear pin 218 comprised of a single shear pin coupling second retainer 213 to piston mandrel 222, a plurality of shear pins, illustratively requested by shear pin 218A, may be utilized in embodiments of apparatus 200. Further, although described above as having a single shear pin coupling the second piston 230 to the first piston 224, a plurality of shear pins, illustratively represented by shear pin 232A in FIG. 2, may be utilized in embodiments of apparatus 200. Other types of shearable devices, such as a shear ring, may be utilized in place of the shear pins illustrated and described in FIG. 2, such as shear ring illustrated and described below with respect to FIG. 6. Further, while illustrated in FIG. 2 as having the shear pin 218 mechanically coupling the second retainer 213 to the stop-step 209 of piston mandrel 222, other variations are possible and are contemplated for the placement of shear pin 218. For example, in various embodiments shear pin 218 is positioned to mechanically couple the uphole portion of first piston 224 to the stop-step 209 of piston mandrel 222, and configured to be shearable based on forces applied to both the first piston 224 and the second piston 230 as described above.

In various embodiments, other types of releasable coupling devices and configurations of releasable mechanisms may be utilized to provide the releasable linking or coupling functions as described above for shear pin 218 and/or for shearable pin 232. Examples may include spring loaded devices, detented check balls, snap rings, locking dogs, and other devices that may be configured to releasably couple a dual-piston assembly including a first piston and a second piston to a fixed position within an apparatus, and to allow the dual-piston assembly to be released, allowing the first piston and the second piston to move together to a different position within the apparatus, as described herein with respect to the functions described above for shear pin 218. Examples of these releasable coupling devices as described herein, and any equivalents thereof, may also be configured to releasably couple a second piston to a first piston of the dual-piston assembly, and be configured to allow the second piston to be released from the first piston, allowing the second piston to move independently in an axial direction relative to the first piston, as described herein for example with respect to the functions described for shearable pin 232. Examples of releasable coupling devices may also be referred to herein as releasable coupling mechanisms. Examples of releasable coupling devices or mechanisms that are also configured to allow reattachment of the devices, such as the second piston to the first piston, after the devices have been released from being coupled to one another by the releasable coupling device may be referred to as a "resettable coupling device" or as a "resettable coupling mechanism" throughout this disclosure.

Figure 3:
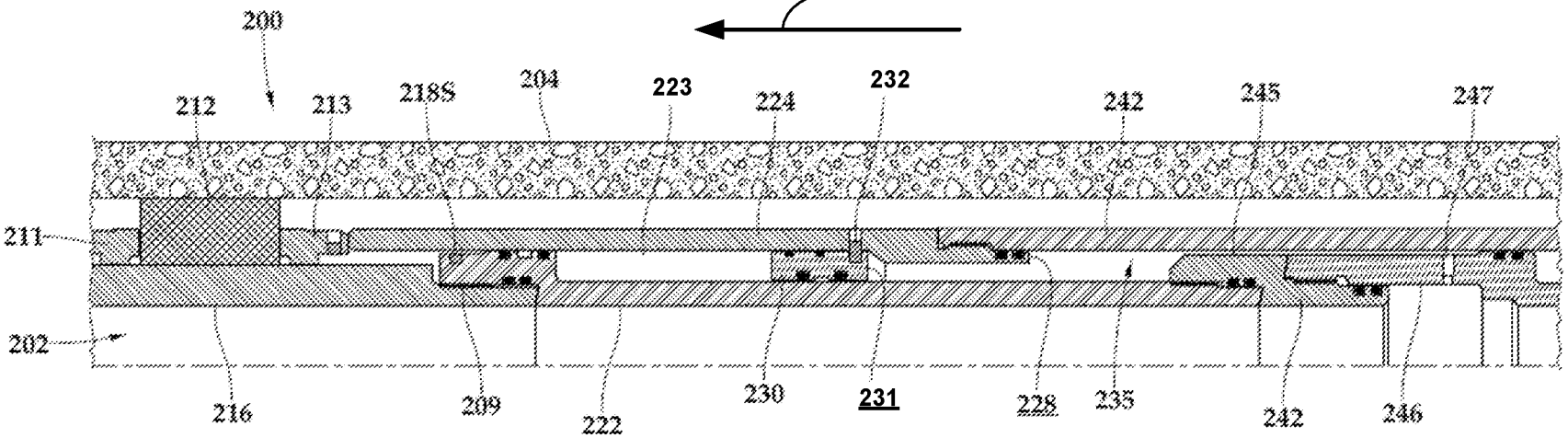
FIG. 3 is a cross-sectional diagram of the packer setting apparatus of FIG. 2 having the sealing element of the apparatus placed in a "set" configuration, in accordance with various embodiments.

FIG. 3 is a cross-section diagram of the packer setting apparatus 200 of FIG. 2, having the sealing element of the apparatus placed in a "set" configuration, in accordance with various embodiments. For the sake of clarity, only the upper half (half above the longitudinal axis 201) of the apparatus 200 from FIG. 2 is reproduced in FIG. 3. In addition, not all reference numbering from FIG. 2 are included in FIG. 3, but only reference numbering most relevant to the differences between the packer apparatus 200 as configured in FIG. 2 relative to the configuration of the apparatus as illustrated in FIG. 3 are provided as part of FIG. 3.

As shown in FIG. 3, the shear pin 218 located at the second retainer 213 is sheared, now identified in FIG. 3 as 218S. The shearing of shear pin 218 forming pin 218S releases the second retainer from being mechanically coupled to the stop-step 209 of piston mandrel 222, and thereby allowing the uphole portion of the first piston 224 to extend over and past the stop-step 209, and to drive the second retainer 213 in a direction moving closer to first retainer 211. The movement of second retainer 213 relative to the fixed position of first retainer 211 compresses or otherwise actuate the sealing element 212, causing the sealing element to expand outward and form a seal with the formation 204. As shown in FIG. 3, shear pin 232 coupling the second piston 230 to first piston 224 has not been sheared. As a result, second piston 230, while moved in the direction indicated by arrow 250, remains located at the same position relative to the central portion of first piston 224 as was provided in the configuration of the apparatus 200 prior to the shearing of shear pin 218. Further, because second piston 230 is still mechanically coupled to first piston 224, any forces applied to the second piston by the fluid pressure present in cavity 235 is transferred to the second retainer 213, and thus also to the sealing element 212, through first piston 224.

In FIG. 3, while the relative positioning of the uphole portion of the outer cover sleeve 242 has moved in the direction of arrow 250 by virtue of the mechanically coupling between the first piston 224 and the outer cover sleeve, the overall length of the outer cover sleeve in the downhole direction allows the inner surface of the outer cover sleeve to maintain the outer surface, and thus the integrity, of cavity 245 and cavity 235 by engagement with one or more seals provided between the outer cover sleeve at the outer surface of collar 246.

Figure 4:
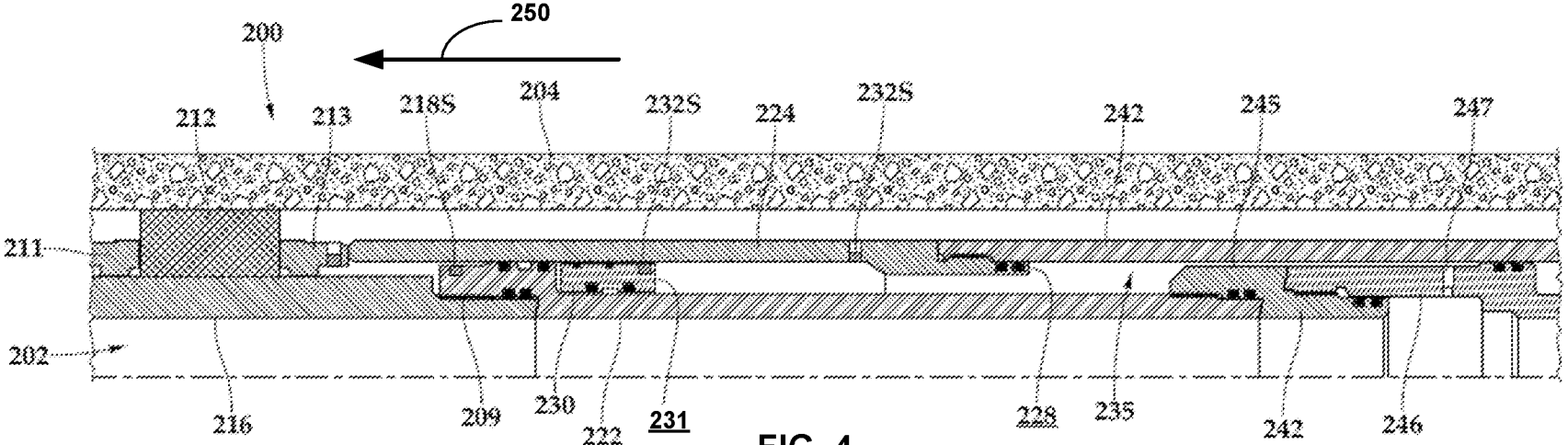
FIG. 4 is a cross-sectional diagram of the packer setting apparatus of FIG. 3 having the second piston moved to the "activated" configuration, in accordance with various embodiments.

The packer apparatus 200 may be moved from the "unset" configuration as illustrated and described above with respect to FIG. 2 to the "set" configuration as illustrated in FIG. 3, but not yet to the "activated" configuration as illustrated and described with respect to FIG. 4, when a fluid pressure level provided at fluid port 247 and to cavity 245 and cavity 235 is at a pressure level that exceeds the minimum seal setting pressure threshold but has not exceeded the fluid pressure level needed to activate the packer apparatus to release the mechanically coupling between the first piston 224 and the second piston 230. When a fluid pressure level provided at fluid port 247 and to cavity 245 and cavity 235 is at a pressure level that exceeds the minimum activation fluid pressure threshold, the shear pin 232 coupling the second piston 230 to the first piston 224 is sheared by the forces exerted on the second piston, and packer apparatus 200 activates to the configuration as illustrated and described below with respect to FIG. 4.

FIG. 4 is a cross-section diagram of the packer setting apparatus 200 of FIG. 3, having the second piston 230 moved to the "activated" configuration, in accordance with various embodiments. For the sake of clarity, only the upper half (the half above the longitudinal axis 201) of the apparatus 200 from FIG. 2 is again reproduced in FIG. 4. In addition, not all reference numbering from FIG. 2 are included in FIG. 4, but only reference numbering most relevant to the differences between the apparatus 200 as configured in FIGS. 2 and 3 relative to the configuration of the apparatus as illustrated in FIG. 4 are provided as part of FIG. 4.

As shown in FIG. 4, the uphole portion of first piston 224 remains in contact with second retainer 213, and therefore any fluid pressure present in cavity 235 may still exert a force in the uphole direction and thereby maintain sealing element 212 in the extended and sealing configuration. As further illustrated in FIG. 4, the pin 232, which had previously mechanically coupled the second piston 230 to the first piston 224, is now sheared, and is identified in FIG. 4 as 232S. The shearing of pin 232 forming pin 232S releases the second piston 230 from being mechanically coupled to the first piston 224, thereby allowing the second piston to move in an uphole direction until the second piston contacts the stop-step 209 of piston mandrel 222. Because piston mandrel 222 is fixed in position longitudinally relative to the first piston 224 and the second retainer 213, any force applied to second piston 230 by virtue of fluid pressure present in cavity 235 is not transferred to the second retainer or to the sealing element 212.

By decoupling the second piston 230 from the first piston as shown in FIG. 4, higher levels of fluid pressures that may be utilized in a fracturing operation and that are communicated to cavity 245 and cavity 235 of apparatus 200 may still exert a force on surfaces of the first piston 224, for example downhole surface 228 of the first piston. However, the total amount of force that would have been transferred to the second retainer 213, and thus to the sealing element 212, is less than the amount of force that would have been transmitted to the second retainer and the sealing element had the second piston remained mechanically coupled to the first piston. By decoupling the second piston 230 from the first piston 224, packer apparatus 200 is able to protect the sealing element 212 from being exposed to forces at a level that could damage the sealing element when the higher fluid pressure levels are provided through fluid passageway 202, and without the need to isolate cavity 245 or cavity 235 from these higher fluid pressure levels. As shown in FIG. 4, when in the activated configuration the higher fluid level pressures that may be used as part of a fracturing operation can still be received at the internal cavities of the apparatus while decreasing the level of force that would otherwise be exerted on the sealing element without the ability of the apparatus to assume the activated configuration.

Figure 5:
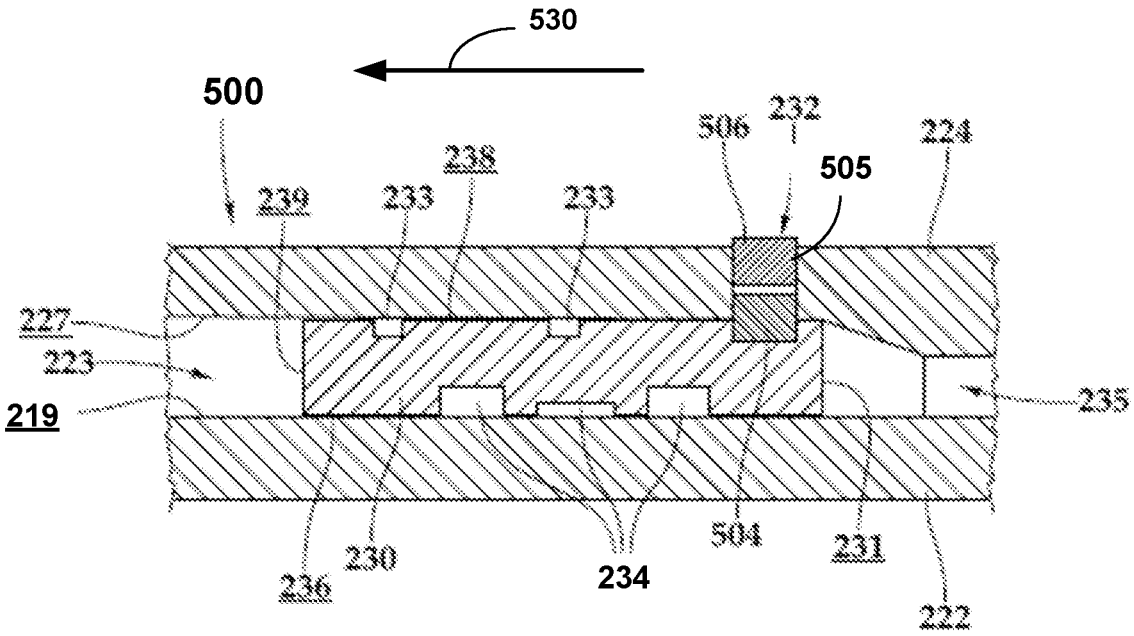
FIG. 5 is a sectional diagram in cross-section of a shear pin apparatus configured as part of a packer setting apparatus, in accordance with various embodiments.

FIG. 5 is a cross-sectional diagram of a shear pin apparatus 500 configured as part of a packer setting apparatus, in accordance with various embodiments. Apparatus 500 may be utilized as part of a packer setting apparatus 200 as illustrated and described above with respect to FIGS. 2-4. In embodiments of packer apparatus 200 that include multiple shear pins coupling the first piston to the second piston of the packer apparatus, a plurality of the shear pins configured as illustrated in FIG. 5 may be positioned at different annular positions around the longitudinal axis of the packer apparatus as described above with respect to various embodiments.

Referring to FIG. 5, one or more inner surfaces 236 of second piston 230 are positioned adjacent outer surface 219 of piston mandrel 222, and one or more outer surfaces 238 of the second piston are positioned adjacent an inner surface 227 of first piston 224. One or more seals 234 provide a fluid seal between the inner surfaces 236 of the second piston 230 and piston mandrel 222, and one or more seals 233 provide a fluid seal between the outer surfaces 238 of the second piston 230 and the first piston 224. A pin 232 extends partially into a cavity 504 extending from outer surfaces 238 of second piston 230 into the second piston. Pin 232 also extends partially into a passageway 505 that extends between the outer surfaces 238 of the second piston 230 and the inner surface 227 of first piston 224. A plug 506 is placed in the portion of the passageway 505 not occupied by pin 232 to seal the passageway 505.

When positioned and arranged as shown in FIG. 5, pin 232 secures the relative positioning between first piston 224 and second piston 230 such that any force applied to the downhole surface 231 of the second piston by fluid pressure present in cavity 235 is also coupled mechanically to the first piston 224 through pin 232. At some threshold level of fluid pressure applied to cavity 235, pin 232 is configured to shear, and thereby allow second piston 230 to move independently relative to the position of first piston 224, and advance further into cavity 223 in a direction indicated by arrow 530. As described above with respect to FIG. 4, as second piston 230 advances further into cavity 223, the uphole surface 239 of the second piston comes into contact with the stop-step 209 of piston mandrel 222, such as in a position as shown in FIG. 4. Once in contact with the stop-step 209 of the piston mandrel 222, any fluid pressure present at the downhole surface 231 of second piston 230 applies forces through the second piston to the stop-step of the mandrel, and which are not transferred to the first piston 224, the second retainer 213, or the sealing element 212 of a packing apparatus. As a result, any higher pressures, such a fluid pressures that may be present in cavity 235 as part of a fracturing procedure being performed on the wellbore where the shear pin apparatus 500 is provided, will not transmit additional forces that are applied to the second piston to the sealing element 212. Without this feature, these forces as applied to the second piston 230, if transferred to the sealing element of a packer apparatus, could potentially damage the sealing element and/or result in the failure of the sealing element.

As shown in FIG. 5, a single shear pin 232 is illustrated as coupling the second piston 230 to the first piston 224. However, as described above, a plurality of pins 232 included as part of a plurality of pin apparatus, may be positioned at different positions radially around the piston section of a packer setting apparatus, each of the plurality of pins configured to shear a same level of fluid pressure applied to the cavity 235 as described above, thus releasing the mechanical linkages provided by the pins between the first piston 224 and the second piston 230, and allowing the second piston to move relative to the position of the first piston and toward and to make contact with the stop-step of the piston mandrel of the packing apparatus as described above.

Figure 6:
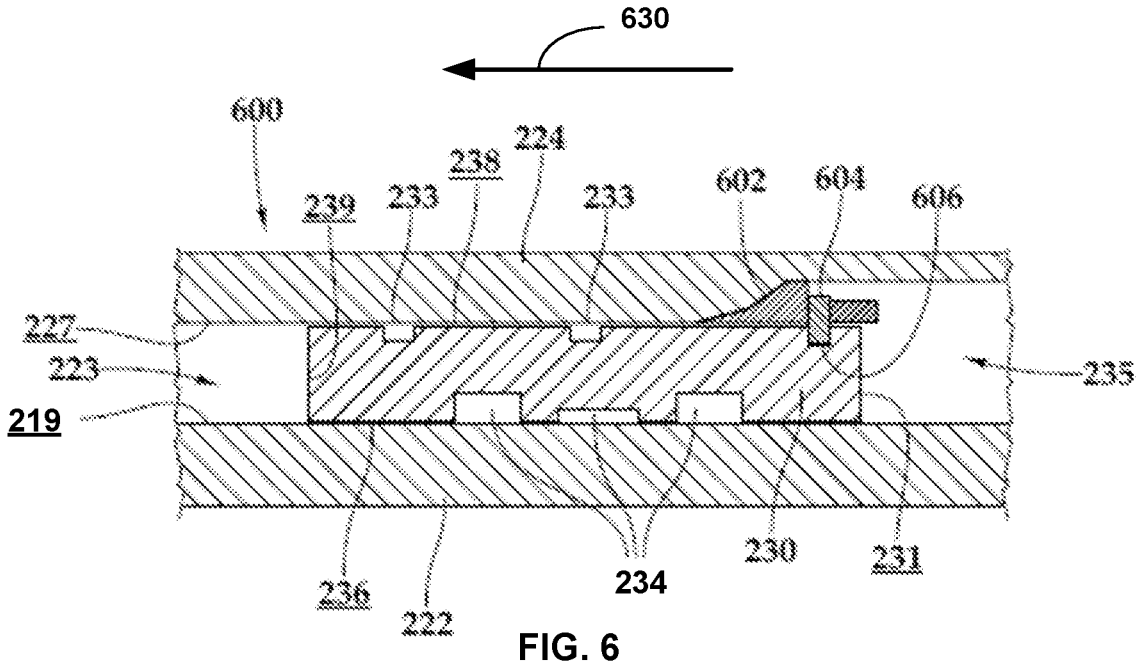
FIG. 6 is a sectional diagram in cross-section of a second shear ring apparatus configured as part of a packer setting apparatus, in accordance with various embodiments.

FIG. 6 is a cross-sectional diagram of a shear ring apparatus 600 configured as part of a packer setting apparatus, in accordance with various embodiments. Shear ring apparatus 600 may be utilized as part of a packer apparatus 200 as illustrated and described above with respect to FIGS. 2-4.

As illustrated in FIG. 6, one or more inner surfaces 236 of second piston 230 are positioned adjacent to an outer surface 219 of piston mandrel 222, and one or more outer surfaces 238 of second piston 230 are positioned adjacent an inner surface 227 of first piston 224. One or more seals 234 provide a fluid seal between the inner surfaces 236 of the second piston 230 and piston mandrel 222, and one or more seals 233 provide a fluid seal between the outer surfaces 238 of the second piston 230 and the first piston 224. A shear ring 604 extends partially into a groove 606, wherein groove 606 extends into a portion of second piston 230 from outer surface 238 of the second piston. In various embodiments, shear ring 604 and groove 606 encircle the second piston 230 around the entirety of the second piston at some radial distance from the longitudinal axis of the tool where the shear ring apparatus 600 is utilized. In various embodiments, shear ring 604 comprises a plurality of individual shear ring segments that are configured to be assembled to form the shear ring 604.

As further illustrated in FIG. 6, a portion of shear ring 604 that extends above groove 606 is adjacent to and in direct physical contact with wedge block 602. A surface of wedge block 602 also faces and is in direct physical contact with a portion of the inner surface 227 of the first piston 224. As a result of this arrangement, any force applied to the downhole surface 231 of the second piston 230 by fluid pressure present in cavity 235 is also coupled mechanically to the first piston 224 through shear ring 604 and wedge block 602. Additional force may be applied to first piston 224 though portions of shear ring 604 and any portions of wedge block 602 that may be in fluid communication with fluid pressure present in cavity 235.

At some threshold level of fluid pressure applied to cavity 235, shear ring 604 is configured to shear, and thereby allow second piston 230 to move relative to the position of first piston 224, and advance further into cavity 223 in a direction indicated by arrow 630. As described above with respect to FIG. 4, as second piston 230 advances further into cavity 223, the uphole surface 239 of the second piston comes into contact with the stop-step 209 of piston mandrel 222, such as in a position as shown in FIG. 4. Once in contact with the stop-step of the piston mandrel 222, any fluid pressure present at the downhole surface 231 of second piston 230 applies forces through the second piston to the stop-step of the piston mandrel, and are not transferred to the first piston 224, the second retainer 213, or the sealing element 212 of a packer apparatus. As a result, any forces exerted on the second piston 230 by the higher fluid pressures levels, such a fluid pressures that may be present in cavity 235 as part of a fracturing procedure being performed on the wellbore where the shear ring apparatus 600 is provided, will not transmit these additional forces to the sealing element 212 of the packer apparatus. Without this feature, these forces as applied to the second piston 230, if transferred to the sealing element, could potentially damage the sealing element and/or result in the failure of the sealing element. At the same time, the primary piston leverages the higher pressure to re-apply the setting load on the element and re-energize it. This is important because an injection usually cools down the downhole temperature which can cause the elements to relax and lose some of its sealing. However, the embodiments as described herein, and any equivalents thereof, allow the primary piston to leverage the higher injection pressure to re-apply the setting load and keep the element energized thereby enhancing its sealing capability.

Figure 7:
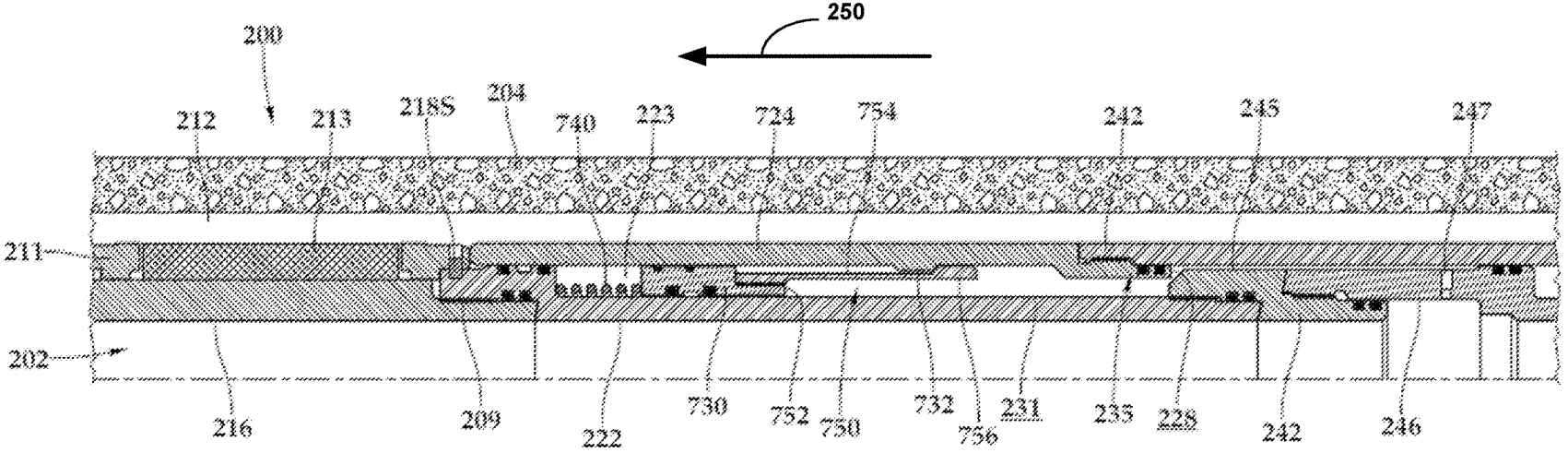
FIG. 7 is a sectional diagram in cross-section of a resettable packer setting apparatus, in accordance with various embodiments.

FIG. 7 is a cross-sectional diagram of a resettable packer setting apparatus 700, in accordance with various embodiments. Reference numbering for resettable packer setting apparatus (apparatus 700), which correspond to a same or similar device or entity as was illustrated and described above with respect to packer setting apparatus 200 (FIGS. 2-6) retain a same corresponding reference number, with variations included in apparatus 700 indicated using reference numbing in the seven hundreds range.

As shown in FIG. 7, apparatus 700 includes a resettable collet 750 that is coupled to second piston 730 at the downhole portion of the second piston. Resettable collet 750 includes a set of fingers 754 that extend in a downhole direction away from the second piston 730, each of the fingers terminating in a respective one of tips 756. Each of the tips 756 is configured to engage a step 732 formed in the inner surface of first piston 724.

Figure 8:
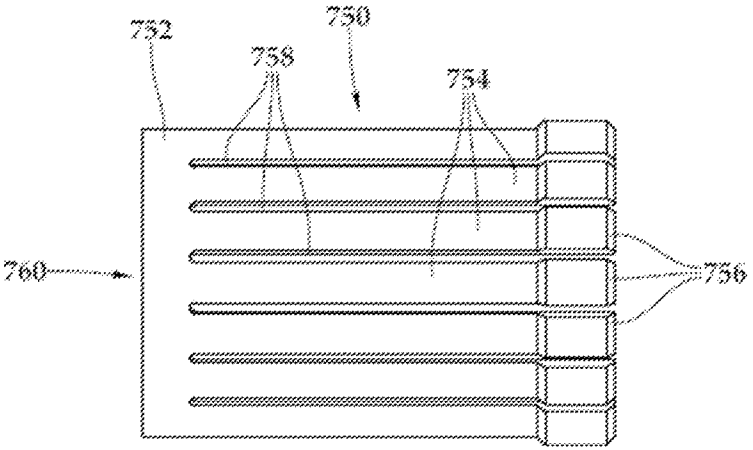
FIG. 8 is a side view of a resettable collet for use with the resettable packer setting apparatus of FIG. 7, in accordance with various embodiments.

FIG. 8 is a side view of resettable collet 750 for use with the resettable packer setting apparatus of FIG. 7, in accordance with various embodiments. As shown in FIG. 8 the resettable collet 750 comprises a cylindrical shape that encircles a passageway 760, the passageway extending through the resettable collet from the uphole end 752 to the tips 756 of the resettable collet. Uphole end 752 of the resettable collet is configured to attach to a portion of second piston 730, as illustrated in FIG. 7, in a non-detachable manner, for example using a threaded connection.

As shown in FIG. 8, resettable collet 750 includes a plurality of fingers 754 arranged around the circumference of the resettable collet, each of the fingers separated by a respective plurality of slits 758, each slit positioned between a set of two adjacent fingers. Each of the fingers 754 terminates in a respective one of tips 756, wherein the tips extend outward radially a distance further away from a central axis 762 of the resettable collet 750. In various embodiments, the resettable collet is made from a material, such as metal, that allows for flexibility of the fingers, and thus the tips 756, in an inward direction radially that allows the tips to move in a direction that is closer to the central axis of the resettable collet, and to also return to the original position and to a same distance from the central axis as shown in FIG. 8.

Referring back to FIG. 7, the apparatus 700 is positioned within apparatus 700 so that the resettable collar encircles piston mandrel 222 and is located within cavity 235. The uphole end 752 of the resettable collet 750 is mechanically coupled to the downhole end of the second piston 730 in a non-detachable fashion, such as a threaded coupling and/or a welded configuration, and the tips 756 of fingers 754 detachably engages with the step 732 of the first piston 724. The engagement between the tips 756 of fingers 754 of the resettable collet 750 and the step 732 is configured to keep the second piston 730 coupled to the first piston 724 when a level of fluid pressure present in cavity 235 is applied to the first piston 724 and the second piston 730 which does not exceed the threshold pressure level required to allow the fingers of resettable collet 750 to disengage from the step 732 of the first piston, and thereby release the mechanical coupling between the first piston 724 and the second piston 730 being provided through the resettable collet. A reset mechanism 740, in some embodiments in the form of a spring, is positioned within cavity 223, and is configured to urge second piston 730 in a downhole direction away from the stop-step 209 of the piston mandrel 222.

In operation, apparatus 700 may be in an initial configuration as shown in FIG. 7 when positioned downhole in a wellbore as part of a downhole tool. Once located at the desired location within the wellbore, an initial level of fluid pressure may be applied to the fluid present in passageway 202, and communicated through fluid port 247 to cavity 235. This initial level of fluid pressure exerts a force on both the first piston 724 and the second piston 730, causing the first piston and the second piston to overcome the force being exerted on the second piston by the reset mechanism 740, and moving the uphole portion of first piston to exert enough force on pin 218 to shear the pin, and move second retainer 213 in a uphole direction as represented by arrow 250 to set the sealing element 212. The initial level of fluid pressure however is not high enough to exert a force on second piston 730 that is adequate to release the tips 756 of fingers 754 from the step 732, and therefore the second piston 730 remains mechanically coupled to the first piston 224.

In various embodiments, after setting the sealing element 212, a higher level of fluid pressure, such as a fluid pressure that may be used as part of a fracturing or well treatment procedure, may be applied to passageway 202, and provided to cavity 235 through fluid port 247. The higher pressure level exceeds a threshold piston release pressure level such that the force exerted on the downhole surface of second piston 730 is adequate to force the fingers 754 of the resettable collet 750 to deflect inward, releasing the fingers from step 732, and allowing the second piston to move in the direction indicated by arrow 250 relative to first piston 724, and become mechanically detached from the first piston.

Figure 9:
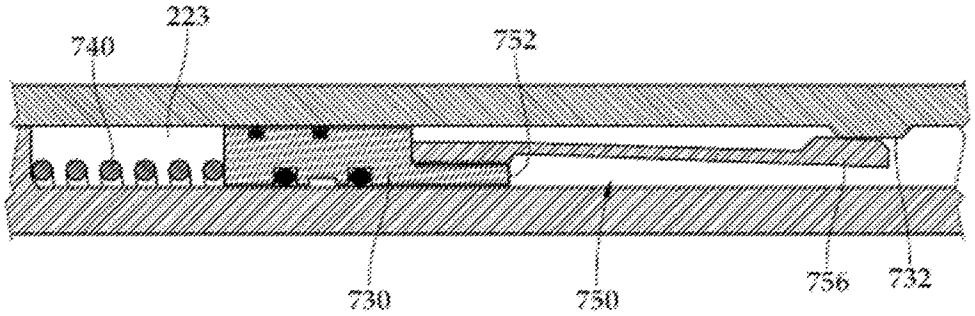
FIG. 9 is a sectional diagram in cross-section of a portion of the resettable packer setting apparatus of FIG. 7, illustrating the resettable collet in a released configuration, in accordance with various embodiments.

FIG. 9 is a cross-sectional diagram of a portion of the resettable packer setting apparatus 700 of FIG. 7, illustrating the resettable collet 750 in a released configuration, in accordance with various embodiments. As shown in FIG. 9, second piston 730 has moved in an uphole direction relative to the first piston 724 to a position where fingers 754 have flexed in an inward direction, and the tips 756 of the fingers 754 have deflected and moved away from step 732 of the inner surface of the first piston, allowing the second piston to be mechanically detached from the first piston.

Referring to both FIG. 7 and FIG. 9, once mechanically detached from the first piston 724, the second piston can further compress the reset mechanism 740 within cavity 223, and any forces exerted on the second piston and on the resettable collet 750 are no longer transferred to the first piston or to the sealing element 212.

At some time after the second piston 730 has been mechanically detached from the first piston 724, the fluid pressure being provided within passageway 202 may be reduced to a level wherein the force being exerted on the second piston 730 by fluid pressure present in cavity 235 is less than a force begin exerted in the downhole direction on the second piston by reset mechanism 740. As a result, the force exerted on the second piston 730 by reset mechanism 740 move the second piston relative to the first piston in a direction opposite the direction illustrated by arrow 250. As the second piston moves in the downhole direction, at some point the tips 756 of fingers 754 will reengage with step 732 of the inner surface of the first piston 724, thus mechanically linking the second piston to the first piston and returning the dual-piston assembly to the initial configuration as shown in FIG. 7. As such, the resettable collet 750 is configured to allow mechanical detachment of the second piston from the first piston based on fluid pressure provided to passageway 202 and cavity 235, while allowing recoupling of the second piston to the first piston again by controlling the fluid pressures provided to passageway 202. The use of the reset collet provides the advantage of allowing alternatingly setting and resetting to the apparatus 700 by controlling the fluid pressure provided to the assembly, and while further protecting the sealing element from damage to higher fluid pressure that may be utilized as part of a fracturing or other wellbore treatment operations without the need to provide addition mechanisms to close off the dual-piston portion the assembly when the higher fracturing fluid pressures are being applied to the passageway 202.

FIG. 1000 illustrates a graph 1000 depicting various configurations of a packer setting apparatus at different fluid pressures, in accordance with various embodiments. Graph 1000 includes a vertical axis 1010 indicative of fluid pressures, and a horizontal axis 1002 indicative of time. Graphical line 1010 is illustrative of various fluid pressures that may be received at a packer setting apparatus having dual pistons as described herein. As shown in graph 1000 at time TO a fluid pressure present at the packer setting apparatus is zero, or at least at a level below a first threshold pressure level indicated by horizontal dashed line 1020. During the time between time T0 and T1, the fluid pressure increases at some rate. Over the time period between time T0 and T1, the fluid pressure has not yet reached the threshold pressure level indicated by horizontal dashed line 1020, and the packer setting apparatus remains in an "unset" configuration, as indicated by bracket 1004. In various embodiments the "unset" configuration may be a configuration as illustrated and described above with respect to packer apparatus 200 and FIG. 2.

Figure 10:
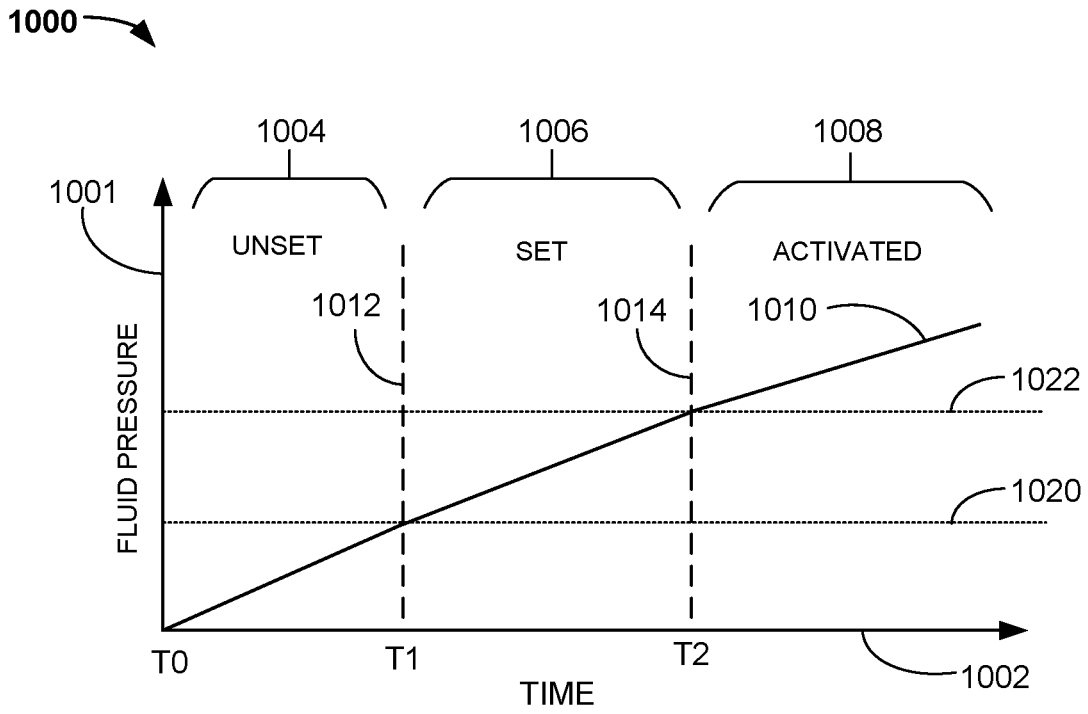
FIG. 10 illustrates a graph depicting various configurations of a packer setting apparatus at different fluid pressures, in accordance with various embodiments.

Referring back to FIG. 10, at time T1 (as indicated by vertical dashed line 1012), the fluid pressure level indicated by graphical line 1010 reaches the first pressure threshold level indicated by horizontal dashed line 1020, and the packer setting apparatus changes to a "set" configuration. Transitioning to the "set" configuration in various embodiments involves shearing a device, such as a shear pin, that allow a first piston and a second piston of the packer apparatus, in combination, to move in the direction of a sealing element of the packer apparatus, compressing the sealing element and causing the sealing element to extend outward and form a hydraulic seal with a formation that is located adjacent to the sealing element. In various embodiments, the packer apparatus remains in the "set" configuration over the time period between time T1 and T2, as represented by bracket 1006. In various embodiments, the "set" configuration may be a configuration as illustrated and described above with respect to packer apparatus 200 and FIG. 3.

Referring again to FIG. 10, at time T2 (as indicated by vertical dashed line 1014), the fluid pressure level as indicated by graphical line 1010 reaches the second pressure threshold level indicated by horizontal dashed line 1022, and the packer setting apparatus changes to an "activated" configuration. Transitioning to the "activated" configuration in various embodiments involves shearing a device, such as a shear pin, that allows the second piston of the packer apparatus to be mechanically separated from the first piston the dual piston apparatus, causing the second piston to move to a position where any forces exerted on the second piston by the fluid pressure present in the packer apparatus are not transferred to the sealing element forming the hydraulic seal between the packer apparatus and the formation. In the "activated" configuration, fluid pressure present in the packer apparatus continues to exert force on the first piston of the apparatus, which in various embodiments is used to maintain a proper level of sealing between the packer apparatus and the formation, while protecting the sealing element of the packer apparatus from excessive forces that would otherwise be exerted on the sealing element if the second piston were not detached from the first piston. In various embodiments, the apparatus remains in the "activated" configuration for some time following time T3, as represented by bracket 1008. The higher pressure level present at the packer apparatus following time T3 may be a result of one or more fracturing operations that are being performed on a wellbore where the packer apparatus is located. In various embodiments, the "activated" configuration may be a configuration as illustrated and described above with respect to apparatus 200 and FIG. 4.

In various embodiments, a range for the fluid pressure levels for transitioning the packer apparatus from the "unset" to the "set" configuration, as indicated by horizontal dashed line 1020 in graph 1000, may be in a range of from 2,000 to 5,000 pounds per square inch, inclusive, (approximately 13,800 to 34,500 kilopascals, inclusive). In various embodiments, a range for the fluid pressure levels for transitioning the packer apparatus from the "set" to the "activated" configuration, as indicated by horizontal dashed line 1022 in graph 1000, may be in a range of from 6,000 to 7,500 pounds per square inch, inclusive, (approximately 41,400 to 51,700 kilopascals, inclusive).

Figure 11:
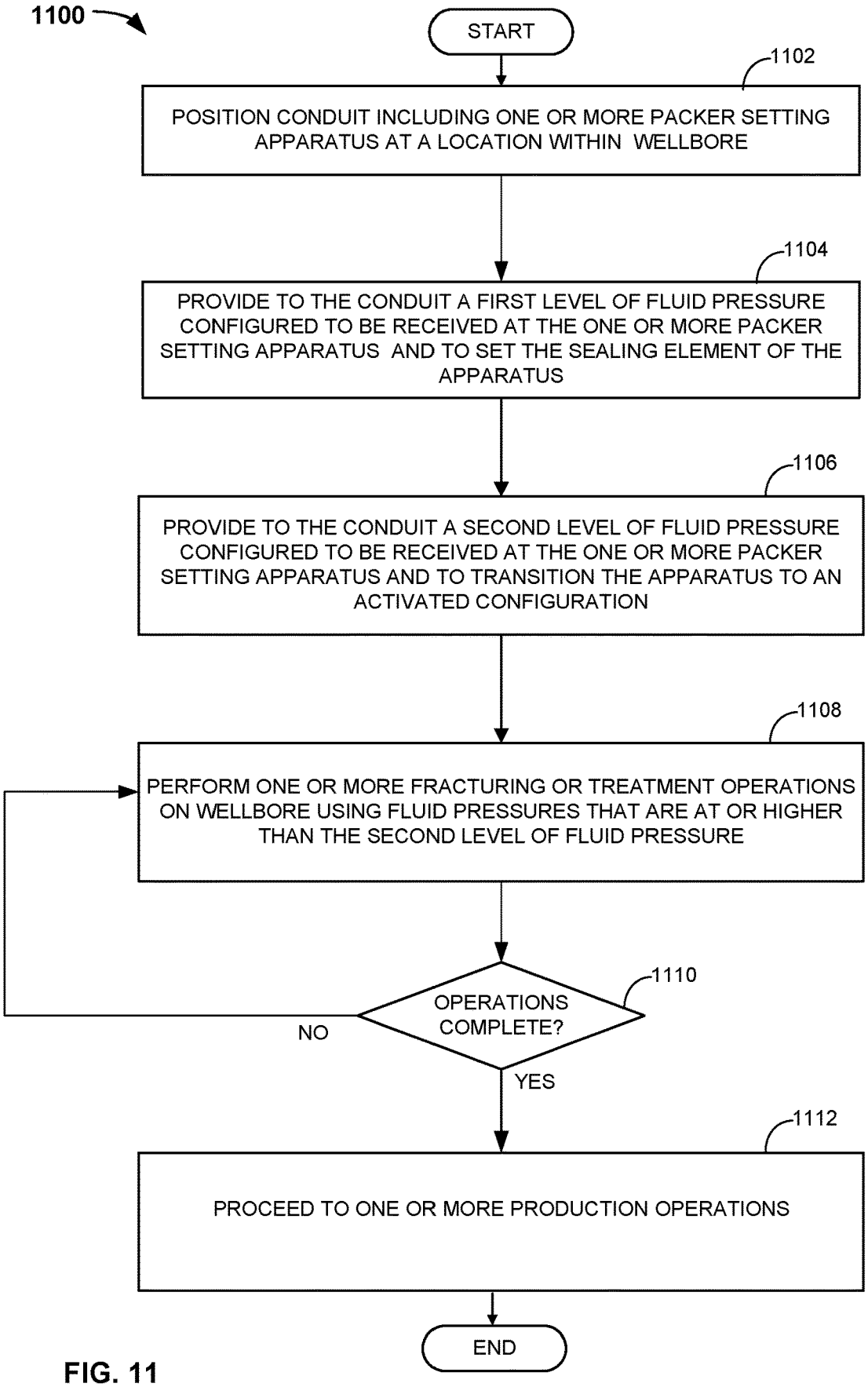
FIG. 11 is a flowchart illustrating a method for setting a packer at a downhole location within a wellbore, in accordance with various embodiments.

FIG. 11 illustrates a flowchart of a method 1100 for setting a packer at a downhole location within a wellbore, in accordance with various embodiments. Embodiments of method 1100 may be performed by one or more devices including in a wellbore system, such as system 100 as illustrated and described with respect to FIG. 1. One or more packer setting apparatus as described throughout this disclosure, such as packer setting apparatus 200 (FIGS. 2-6) may be utilized in the execution of the steps performed by method 1100.

Embodiments of method 1100 include positioning a conduit within a wellbore, the conduit comprising one or more packer setting apparatus, the conduit positioned within the wellbore so that the one or more packer setting apparatus are positioned at respective locations where a packer is to be set in order to isolate one portions of an annulus surrounding the conduit for another portion of the annulus (block 1102). In various embodiments, the conduit includes a fluid passageway that extends from the surface of the wellbore to each of the one or more packer setting apparatus. The conduit is configured to deliver a fluid at some fluid pressure through the conduit, the fluid to be received at each of the one or more packer apparatus.

Embodiments of method 1100 include providing a first level of fluid pressure through the conduit to be received at the one or more packer setting apparatus (block 1104). The first level of fluid pressure is configured to transition the one or more packer setting apparatus from an "unset" configuration to a "set" configuration. Transitioning the one or more packer setting apparatus from the "unset" to the "set" configuration comprises applying the first level of fluid pressure received at the one or more packer setting apparatus to a both a first piston and a second piston included in each one of the one or more packer setting apparatus, resulting in the releasing of a device holding the first piston and the second piston in a fixed position within the packer setting apparatus, and allowing the combination of the first piston and the second piston to move in a direction within the packer setting apparatus that compresses the sealing element of the packer setting apparatus. Compressing the sealing element of the packer setting apparatus causes the sealing element to extend away from the packer setting apparatus and to contact and form a hydraulic seal with a formation of the wellbore that is adjacent to the packer setting apparatus.

Embodiments of method 1100 include providing a second level of fluid pressure through the conduit to be received at the one or more packer setting apparatus (block 1106). The second level of fluid pressure is configured to transition the one or more packer setting apparatus from a "set" configuration to an "activated" configuration. The second level of fluid pressure is a fluid pressure level that is higher than the pressure level of the first level of fluid pressure. Transitioning the one or more packer setting apparatus from the "set" to the "activated" configuration comprises applying the second level of fluid pressure received at the one or more packer setting apparatus to the second piston included in each one of the one or more packer setting apparatus, resulting in the releasing of a device holding the second piston to the first piston, by for example shearing a shear pin or a shear ring that is mechanically linking the second piston to the first piston.

In various embodiments, releasing the second piston from the mechanical linkage to the first piston allows the second fluid pressure to move the second piston to a position where any forces applied by the second fluid pressure to the second piston are no longer transferred to the sealing element of the packer apparatus. In various embodiments, in the "activated" configuration, compression of the sealing element of the packer setting apparatus is maintained by the force applied by the second fluid pressure acting on the first piston alone, and is less than the resultant force that would be exerted on the sealing element if the second piston were still mechanically linked to the first piston.

Embodiments of method 1100 include performing one or more fracturing and/or wellbore treatment operations on the wellbore using fluid pressures that are higher than the second fluid pressure (block 1108). The one or more fracturing and/or wellbore treatment operations are performed on the wellbore while the packer setting apparatus remains in the "activated" configuration. As such, the sealing elements of the packer setting apparatus are protected from the higher fluid pressures of these operations while still receiving the higher fluid pressure within the packer apparatus.

Embodiments of method 1100 include determining if the wellbore operations being performed on the wellbore where the "activated" packer apparatus are located have been completed (block 1110). If a determination is made that the wellbore operations are not completed ("NO" branch extending from block 1110), embodiments of method 1100 return to block 1108, where more wellbore operations are performed. If a determination is made that the wellbore operations are completed, ("YES" branch extending from block 1110), embodiments of method 1100 proceed to block 1112.

At block 1112, embodiments of method 1100 include moving from a fracturing and/or well treatment operation(s) to a production operation. In various embodiments, moving to a production operation includes extraction of a product or products, such as gas or crude oil, from the wellbore through the same conduit that was positioned within the wellbore during the fracturing or other well treatment operations.

Figure 12:
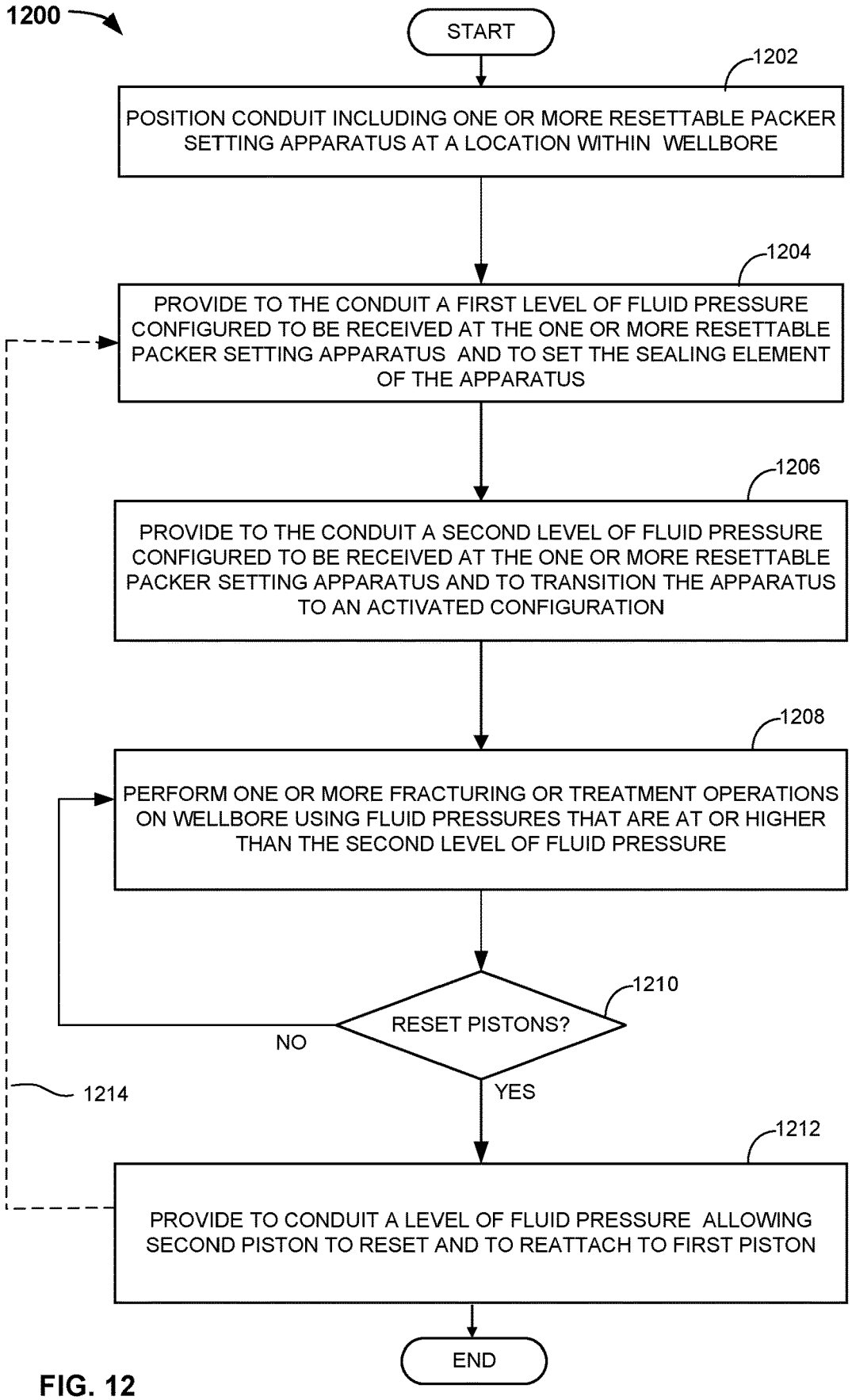
FIG. 12 is a flowchart illustrating a method for setting a packer at a downhole location within a wellbore using a resettable packer setting assembly, in accordance with various embodiments.

FIG. 12 illustrates a flowchart of a method 1200 for setting a packer at a downhole location within a wellbore using a resettable packer setting apparatus, in accordance with various embodiments. Embodiments of method 1200 may be performed by one or more devices including in a wellbore system, such as system 100 as illustrated and described with respect to FIG. 1 and one or more packer setting apparatus as described, for example by resettable packer setting apparatus 700 (FIGS. 7-69 may be utilized in the execution of the steps performed by method 1200.

Embodiments of method 1200 include positioning a conduit within a wellbore, the conduit comprising one or more resettable packer setting apparatus, the conduit positioned within the wellbore so that the one or more resettable packer setting apparatus are positioned at respective locations where a packer is to be set in order to isolate one portion of an annulus surrounding the conduit for another portion of the annulus (block 1202). In various embodiments, the conduit includes a fluid passageway that extends from the surface of the wellbore to each of the one or more resettable packer setting apparatus. The conduit is configured to deliver a fluid at some fluid pressure through the conduit, the fluid to be received at each of the one or more resettable packer setting apparatus.

Embodiments of method 1200 include providing a first level of fluid pressure through the conduit to be received at the one or more resettable packer setting apparatus (block 1204). The first level of fluid pressure is configured to transition the one or more resettable packer setting apparatus from an "unset" configuration to a "set" configuration. Transitioning the one or more resettable packer setting apparatus from the "unset" to the "set" configuration comprises applying the first level of fluid pressure received at the one or more resettable packer setting apparatus to a both a first piston and a second piston included in each one of the one or more resettable packer setting apparatus, resulting in the releasing of a device holding the first piston and the second piston in a fixed position within the resettable packer setting apparatus, and allowing the combination of the first piston and the second piston to move in a direction within the resettable packer setting apparatus that compresses the sealing element of the resettable packer setting apparatus. Compressing the sealing element of the packer setting apparatus causes the sealing element to extend away from the resettable packer setting apparatus and to contact and form a hydraulic seal with a formation of the wellbore that is adjacent to the packer setting apparatus.

Embodiments of method 1200 include providing a second level of fluid pressure through the conduit to be received at the one or more resettable packer setting apparatus (block 1206). The second level of fluid pressure is configured to transition the one or more resettable packer setting apparatus from a "set" configuration to an "activated" configuration. The second level of fluid pressure is a fluid pressure level that is higher than the pressure level of the first level of fluid pressure. Transitioning the one or more resettable packer setting apparatus from the "set" to the "activated" configuration comprises applying the second level of fluid pressure received at the one or more resettable packer setting apparatus to the second piston included in each one of the one or more resettable packer setting apparatus, resulting in the releasing of a resettable device holding the second piston to the first piston, by for example the resettable collet 750 as illustrated and described with respect to FIGS. 7-9 above.

In various embodiments, releasing the second piston from being mechanical attached at a fixed position relative to the first piston allows the second fluid pressure to move the second piston to a position where any forces applied by the second fluid pressure to the second piston are no longer transferred to the sealing element of the apparatus. In various embodiments, in the "activated" configuration, compression of the sealing element of the resettable packer setting apparatus is maintained by the force applied by the second fluid pressure acting on the first piston alone, and is less than the resultant force that would be exerted on the sealing element if the second piston were still mechanically linked in a fixed position relative to the first piston.

Embodiments of method 1200 include performing one or more fracturing or wellbore treatment operations on the wellbore using fluid pressures that are higher than the second fluid pressure (block 1208). The one or more fracturing or wellbore treatment operations are performed on the wellbore while the resettable packer setting apparatus remains in the "activated" configuration. As such the sealing elements of the resettable packer setting apparatus are protected from the higher fluid pressures of these operations while still receiving the higher fluid pressure within the packer apparatus.

Embodiments of method 1200 include determining if the second piston of the resettable packer assembly should be reset (block 1210). In various embodiments the second piston may be reset in order to release and reset the sealing element of the resettable packer assembly. If a determination is made that a reset of the second piston is not required, ("NO" branch extending from block 1210), embodiments of method 1200 return to block 1208, where more wellbore operations may be performed. If a determination is made that the second piston is to be reset, ("YES" branch extending from block 1210), embodiments of method 1200 proceed to block 1212.

At block 1212, embodiments of method 1200 include providing to the conduit a level of fluid pressure that allows the second piston to reset and reattach to the first piston of the resettable packer setting apparatus. In various embodiments, allowing the second piston to reset and reattach to the first piston includes reducing the level of fluid pressure within the resettable packer setting apparatus below a fluid pressure level required to overcome a force being applied to the second piston a reset mechanism, (such as a spring, reset mechanism 740-FIG. 7), so that the reset mechanism urges the second piston in a direction relative to the first piston and allows a latching mechanism (tips 756 of fingers 754, FIGS. 7-9) to reengage with a step portion of the first piston, thereby reattaching mechanically the second piston to the first piston. In various embodiments, upon completion of the attachment of the second piston to the first piston, embodiments of method 1200 may include returning to block 1204, wherein the first level of fluid pressure is provided through the conduct to reset the sealing elements of the resettable packer setting apparatus. In various embodiments, upon completion of the reattachment of the second piston to the first piston, method 1200 may end.

While the aspects of the disclosure are described with reference to various implementations and exploitations, it will be understood that these aspects are illustrative and that the scope of the claims is not limited to them. In general, techniques for activating downhole apparatus, including a sealing element of a packer as described herein, may be implemented with facilities consistent with any hardware, software, and other system or apparatus as described herein, and any equivalents thereof. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example embodiments include the following.

Embodiment 1. An apparatus comprising: a seal section configured to encircle a conduit of a downhole tool, the seal section comprising a sealing element configured to encircle the conduit, the sealing element further configured to extend outward and form a hydraulic seal between the downhole tool and an inner wall of a wellbore where the downhole tool is located when the sealing element is actuated by axial movement of one or more components of the downhole tool; and a piston section coupled to the seal section, the piston section comprising a first piston and a second piston detachably coupled to the first piston, the first piston and the second piston detachably secured at an initial position within the piston section by a first releasable coupling device, wherein the first releasable coupling device is configured to be release when a fluid pressure level received at the piston section reaches a threshold packer setting pressure level configured to cause the first releasable coupling device to release both the first piston and the second piston while the second piston remains detachably coupled to the first piston, the threshold packer setting pressure level configured to urge the first piston and the second piston to move in a direction toward the sealing element to actuate the sealing element and cause the sealing element to form the hydraulic seal between the downhole tool and the inner wall of the wellbore.

Embodiment 2. The apparatus of embodiment 1, wherein the second piston is detachably coupled to the first piston by a second releasable coupling device configured to shear and to allow the second piston to detach from the first piston and to move independently of the first piston when an activation threshold pressure level of fluid pressure that is higher than the threshold packer setting pressure level received at the piston section from the conduit.

Embodiment 3. The apparatus of embodiment 2, wherein the second piston is configured to remain in fluid communication with the fluid pressure received at the piston section following the detachment of the second piston from the first piston and to move to a position within the packer setting assembly wherein any forces applied to the second piston by fluid pressure received at the piston section are not transferred to the sealing element.

Embodiment 4. The apparatus of embodiments 2 or 3, wherein the first piston is configured to remain in fluid communication with the fluid pressure received at the piston section following the detachment of the second piston from the first piston, and to continue to transfer a force exerted on first piston by the fluid pressure to the sealing element.

Embodiment 5. The apparatus of any one of embodiments 2-4, wherein at least a portion of the second piston remains in fluid communication with the fluid pressure provided through the conduit after the second piston has been released from the first piston and to move to contact a stop-step of a piston mandrel included within the piston section.

Embodiment 6. The apparatus of any one of embodiments 2-5, wherein the activation threshold pressure level is a fluid pressure in a range from 6,000 to 10,000 pounds per square inch, inclusive.

Embodiment 7. The apparatus of any one of embodiments 2-6, wherein the second releasable coupling device comprises one or more shear pins.

Embodiment 8. The apparatus of any one of embodiments 2-6, wherein the second releasable coupling device comprises a shear ring.

Embodiment 9. The apparatus of any one of embodiments 1-8, wherein the threshold packer setting pressure level is a fluid pressure in a range from 3,000 to 5,000 pounds per square inch, inclusive.

Embodiment 10. The apparatus of any one of embodiments 1-9, wherein the sealing element is formed from an elastic material comprising rubber.

Embodiment 11. The apparatus of any one of embodiments 1-10, wherein the first releasable coupling device is formed from a material comprising metal.

Embodiment 12. The apparatus of any one of embodiments 1-11, further comprising: a fluid communication section coupled to the piston section, the fluid communication section comprising a fluid port and a fluid passageway, the fluid port configured to provide fluid communication between a fluid provided through the conduit and the fluid passageway, the fluid passageway in fluid communication with a cavity of the piston section, the fluid port and the fluid passageway configured to provide fluid pressures provided through the conduit to the cavity of the piston section and to exert forces generated by the fluid pressures onto both the first piston and the second piston.

Embodiment 13. An apparatus comprising: a seal section configured to encircle a conduit of a downhole tool, the seal section comprising a sealing element configured to encircle the conduit, the sealing element further configured to extend outward and form a hydraulic seal between the downhole tool and an inner wall of a wellbore where the downhole tool is located when the sealing element is actuated by the axial movement of one or more components of the downhole tool; and a piston section coupled to the seal section, the piston section comprising a first piston and a second piston detachably coupled to the first piston, the first piston and the second piston detachably secured at an initial position within the piston section by a releasable coupling mechanism, wherein the releasable coupling device is configured to be releasable when a fluid pressure level received at the piston section reaches a threshold packer setting pressure level configured to cause the first releasable coupling device to release both the first piston and the second piston while the second piston remains detachably coupled to the first piston, the threshold packer setting pressure level configured to urge the first piston and the second piston in a direction toward the sealing element to actuate the sealing element and cause the sealing element to form the hydraulic seal between the downhole tool and the inner wall of the wellbore, and wherein the wherein the second piston is detachably coupled to the first piston by a resettable coupling device configured to allow the second piston to detach from the first piston and to move independently of the first piston when an activation threshold pressure level of fluid pressure that is higher than the threshold packer setting pressure level provided at the piston section from the conduit, the resettable coupling device configured to allow the second piston to reattach to the first piston when the fluid pressure provided at the piston section from the conduit drops below the activation threshold pressure level.

Embodiment 14. The apparatus of embodiment 13, wherein the resettable coupling device comprises a resettable collet having a cylindrical shape and including a plurality of fingers separated from one another by a plurality of slits, each of the plurality of fingers terminated at one end of the finger in a tip that is configured to engage with a step located on an inner surface of the first position.

Embodiment 15. The apparatus of embodiments 13 or 14, wherein the piston section further comprises a reset mechanism configured to urge the second piston to move in an axial direction relative to the first piston.

Embodiment 16. A method comprising: positioning a conduit of a downhole tool including one or more packer setting apparatus within a wellbore, each of the packer setting apparatus comprising a seal section coupled to a piston section, the seal section comprising a sealing element encircling the conduit and configured to extend outward and form a hydraulic seal between the downhole tool and an inner wall of a wellbore where the downhole tool is located when the sealing element is activated by axial movement of a first piston and a second piston of the piston section; and providing a first level of fluid pressure through the conduit to the piston section, the first level of fluid pressure transitioning the one or more packer setting apparatus from an "unset" configuration to a "set" configuration, including applying the first level of fluid pressure received at the one or more packer setting apparatus to a both the first piston and the second piston included in the piston section resulting in releasing a first releasable coupling device holding both the first piston and the second piston in a fixed position within the packer setting apparatus, and allowing the combination of the first piston and the second piston to move in a direction within the packer setting apparatus that actuates the sealing element of the packer apparatus to form the hydraulic seal between the downhole tool and the inner wall of a wellbore, wherein the second piston is detachably coupled to the first piston by a second releasable coupling device configured to release and allow the second piston to separate from the first piston at a second level of fluid pressure received at the piston section and that is higher than the first level of fluid pressure.

Embodiment 17. The method of embodiment 16, further comprising: providing through the conduit to the piston section the second level of fluid pressure that is higher than the first level of fluid pressure, the second level of fluid pressure transitioning the one or more packer setting apparatus from an "set" configuration to a "activated" configuration, including releasing the second releasable coupling device coupling the second piston to the first piston and allowing the second piston to move independently of the first piston.

Embodiment 18. The method of embodiments 16 or 17, wherein the first pressure level is in a range from 2000 to 5000 pounds per square inch, inclusive, and wherein the second pressure level of fluid pressure is in a range from 6,000 to 10,000 pounds per square inch, inclusive.

Embodiment 19. The method of any one of embodiments 16-18, further comprising: performing one or more fracturing or wellbore treatment operations on the wellbore using fluid pressures provided through the conduit at fluid pressure levels that are higher than the second level of fluid pressure and while the piston section, the first piston, and the second piston all remain in fluid communication with fluid pressure provided through the conduit for performing the one or more fracturing or wellbore treatment operations.

Embodiment 20. The method of embodiment 19, further comprising: following completion of the one or more fracturing or wellbore treatment operations, lowering the fluid pressure being provided through the conduit to a level that allows the second piston to be urged by a reset mechanism to move the second piston in a direction relative to the first piston to a position wherein the second releasable coupling device is a resettable mechanism that reattaches the second piston to the first piston.

What is claimed is:

1. An apparatus comprising:

a seal section configured to encircle a conduit of a downhole tool, the seal section comprising a sealing element formed from an elastic and compressible material configured to encircle the conduit, the sealing element further configured to extend outward and form a hydraulic seal between the downhole tool and an inner wall of a wellbore where the downhole components of the downhole tool; and a piston section coupled to the seal section, the piston section comprising a first piston and a second piston detachably coupled to the first piston, the first piston and the second piston detachably secured at an initial position within the piston section by a first releasable coupling device, wherein the first releasable coupling device is configured to release when a fluid pressure level received at the piston section reaches a threshold packer setting pressure level configured to cause the first releasable coupling device to release both the first piston and the second piston while the second piston remains detachably coupled to the first piston, the threshold packer setting pressure level configured to urge the first piston and the second piston to move in a direction toward the sealing element to actuate the sealing element and cause the sealing element to form the hydraulic seal between the downhole tool and the inner wall of the wellbore; and wherein the second piston is detachably coupled to the first piston by a second releasable coupling device configured to release and to allow the second piston to detach from the first piston and to move independently of the first piston when an activation threshold pressure level of fluid pressure that is higher than the threshold packer setting pressure level received at the piston section from the conduit.

2. The apparatus of claim 1, wherein the second piston is configured to remain in fluid communication with the fluid pressure received at the piston section following detachment of the second piston from the first piston and to move to a position within the piston section wherein any forces applied to the second piston by fluid pressure received at the piston section are not transferred to the sealing element.

3. The apparatus of claim 1, wherein the first piston is configured to remain in fluid communication with the fluid pressure received at the piston section following the detachment of the second piston from the first piston, and to continue to transfer a force exerted on the first piston by the fluid pressure to the sealing element.

4. The apparatus of claim 1, wherein at least a portion of the second piston remains in fluid communication with the fluid pressure provided through the conduit after the second piston has been released from the first piston and to move to contact a stop-step of a piston mandrel included within the piston section.

5. The apparatus of claim 1, wherein the activation threshold pressure level is a fluid pressure in a range from 6,000 to 10,000 pounds per square inch, inclusive.

6. The apparatus of claim 1, wherein the second releasable coupling device comprises one or more shear pins.

7. The apparatus of claim 1, wherein the second releasable coupling device comprises a shear ring.

8. The apparatus of claim 1, wherein the threshold packer setting pressure level is a fluid pressure in a range from 3,000 to 5,000 pounds per square inch, inclusive.

9. The apparatus of claim 1, wherein the elastic and compressible material forming the sealing element comprises rubber.

10. The apparatus of claim 1, wherein the first releasable coupling device is formed from a material comprising metal.

11. The apparatus of claim 1, further comprising:

a fluid communication section coupled to the piston section, the fluid communication section comprising a fluid port and a fluid passageway, the fluid port configured to provide fluid communication between a fluid provided through the conduit and the fluid passageway, the fluid passageway in fluid communication with a cavity of the piston section, the fluid port and the fluid passageway configured to provide fluid pressures provided through the conduit to the cavity of the piston section and to exert forces generated by the fluid pressures onto both the first piston and the second piston.

12. An apparatus comprising:

a seal section configured to encircle a conduit of a downhole tool, the seal section comprising a sealing element formed from an elastic and compressible material configured to encircle the conduit, the sealing element further configured to extend outward and form a hydraulic seal between the downhole tool and an inner wall of a wellbore where the downhole tool is located when the sealing element is actuated by an axial movement of one or more components of the downhole tool; and a piston section coupled to the seal section, the piston section comprising a first piston and a second piston detachably coupled to the first piston, the first piston and the second piston detachably secured at an initial position within the piston section by a releasable coupling device, wherein the releasable coupling device is configured to be releasable when a fluid pressure level received at the piston section reaches a threshold packer setting pressure level configured to cause the releasable coupling device to release both the first piston and the second piston while the second piston remains detachably coupled to the first piston, the threshold packer setting pressure level configured to urge the first piston and the second piston in a direction toward the sealing element to actuate the sealing element and cause the sealing element to form the hydraulic seal between the downhole tool and the inner wall of the wellbore, and wherein the second piston is detachably coupled to the first piston by a resettable coupling device comprising a collet that is configured to allow the second piston to detach from the first piston and to move independently of the first piston when an activation threshold pressure level of fluid pressure that is higher than the threshold packer setting pressure level provided at the piston section from the conduit, the resettable coupling device configured to allow the second piston to reattach to the first piston when the fluid pressure provided at the piston section from the conduit drops below the activation threshold pressure level.

13. The apparatus of claim 12, wherein the resettable coupling device comprises a resettable collet having a cylindrical shape and including a plurality of fingers separated from one another by a plurality of slits, each of the plurality of fingers terminated at one end of the finger in a tip that is configured to engage with a step located on an inner surface of the first piston.

14. The apparatus of claim 12, wherein the piston section further comprises a reset mechanism comprising a spring that is configured to urge the second piston to move in an axial direction relative to the first piston.

15. A method comprising:

positioning a conduit of a downhole tool including one or more packer setting apparatus within a wellbore, each of the packer setting apparatus comprising a seal section coupled to a piston section, the seal section comprising a sealing element formed from an elastic and compressible material encircling the conduit and configured to extend outward and form a hydraulic seal between the downhole tool and an inner wall of the wellbore where the downhole tool is located when the sealing element is activated by axial movement of a first piston and a second piston of the piston section; and providing a first level of fluid pressure through the conduit to the piston section, the first level of fluid pressure transitioning the one or more packer setting apparatus from an "unset" configuration to a "set" configuration, including applying the first level of fluid pressure received at the one or more packer setting apparatus to a both the first piston and the second piston included in the piston section resulting in releasing a first releasable coupling device holding both the first piston and the second piston in a fixed position within the packer setting apparatus, and allowing the combination of the first piston and the second piston to move in a direction within the packer setting apparatus that actuates the sealing element of the packer setting apparatus to form the hydraulic seal between the downhole tool and the inner wall of the wellbore, wherein the second piston is detachably coupled to the first piston by a second releasable coupling device configured to release and allow the second piston to separate from the first piston at a second level of fluid pressure received at the piston section and that is higher than the first level of fluid pressure.

16. The method of claim 15, further comprising:

providing through the conduit to the piston section the second level of fluid pressure that is higher than the first level of fluid pressure, the second level of fluid pressure transitioning the one or more packer setting apparatus from an "set" configuration to a "activated" configuration, including releasing the second releasable coupling device coupling the second piston to the first piston and allowing the second piston to move independently of the first piston.

17. The method of claim 15, wherein the first pressure level is in a range from 2000 to 5000 pounds per square inch, inclusive, and wherein the second pressure level of fluid pressure is in a range from 6,000 to 10,000 pounds per square inch, inclusive.

18. The method of claim 15, further comprising:

performing one or more fracturing or wellbore treatment operations on the wellbore using fluid pressures provided through the conduit at fluid pressure levels that are higher than the second level of fluid pressure and while the piston section, the first piston, and the second piston all remain in fluid communication with fluid pressure provided through the conduit for performing the one or more fracturing or wellbore treatment operations.

19. The method of claim 18, further comprising:

following completion of the one or more fracturing or wellbore treatment operations, lowering the fluid pressure being provided through the conduit to a level that allows the second piston to be urged by a reset mechanism comprising a spring to move the second piston in a direction relative to the first piston to a position wherein the second releasable coupling device is a a resettable coupling device comprising a collet that reattaches the second piston to the first piston.

* * * * *